US010052884B2

(12) United States Patent
Komai et al.

(10) Patent No.: US 10,052,884 B2
(45) Date of Patent: Aug. 21, 2018

(54) LABEL ISSUING APPARATUS

(71) Applicant: Ishida Co., Ltd., Kyoto (JP)

(72) Inventors: Naoki Komai, Ritto (JP); Osamu Hiraiwa, Ritto (JP); Suguru Doiguchi, Itabashi-ku (JP)

(73) Assignee: Ishida Co., Ltd., Kyoto (JP)

( * ) Notice: Subject to any disclaimer, the term of this patent is extended or adjusted under 35 U.S.C. 154(b) by 0 days.

(21) Appl. No.: 14/921,748

(22) Filed: Oct. 23, 2015

(65) Prior Publication Data

US 2016/0114596 A1 Apr. 28, 2016

(30) Foreign Application Priority Data

Oct. 28, 2014 (JP) ..... 2014-218786
Mar. 20, 2015 (JP) ..... 2015-057428
Mar. 20, 2015 (JP) ..... 2015-057429

(51) Int. Cl.

| | |
|---|---|
| ***B65C 9/46*** | (2006.01) |
| ***B41J 3/407*** | (2006.01) |
| ***B31D 1/02*** | (2006.01) |
| ***B65C 9/18*** | (2006.01) |
| ***B65C 11/02*** | (2006.01) |

(52) U.S. Cl.

CPC ..... *B41J 3/4075* (2013.01); *B31D 1/021* (2013.01); *B31D 1/027* (2013.01); *B65C 9/183* (2013.01); *B65C 9/46* (2013.01); *B65C 11/0284* (2013.01); *B65C 2009/1888* (2013.01)

(58) Field of Classification Search

USPC ..... 428/40–45

See application file for complete search history.

(56) References Cited

U.S. PATENT DOCUMENTS 2,170,147 A * 8/1939 Lane ..... B65D 73/02 206/447
3,692,176 A * 9/1972 Templeton ..... B65D 83/12 206/389

(Continued)

FOREIGN PATENT DOCUMENTS

JP H4-232986 A 8/1992
JP H11-249571 A 9/1999

(Continued)

OTHER PUBLICATIONS

International Search Report and Written Opinion of the International Searching Authority; PCT/JP2016/053855 dated Apr. 5, 2016.

(Continued)

*Primary Examiner* — Matthew Luu
*Assistant Examiner* — Lily Kemathe
(74) *Attorney, Agent, or Firm* — Studebaker & Brackett PC

(57) ABSTRACT

A label issuing apparatus of an embodiment includes a print unit that prints commodity information on a linerless label, a feeding unit that feeds the linerless label, a cutting unit that detaches the linerless label as a label piece, and a temporary adhesion unit that holds the label piece, and superimposes an upstream end portion in a feeding direction of the held label piece on a downstream end portion in a feeding direction of a subsequent label, the subsequent label being the linerless label next fed by the feeding unit.

18 Claims, 17 Drawing Sheets

(56) References Cited

U.S. PATENT DOCUMENTS

| | | | | |
|---|---|---|---|---|
| 4,009,065 | A * | 2/1977 | Mikulas | B65H 19/10 156/159 |
| 5,226,560 | A * | 7/1993 | Jones | B65H 5/28 221/70 |
| 5,324,078 | A * | 6/1994 | Bane | G09F 3/10 281/2 |
| 6,379,790 | B1 | 4/2002 | Langan | |
| 7,503,995 | B2 * | 3/2009 | Hayasaka | B29C 63/0013 156/247 |
| 7,541,080 | B2 * | 6/2009 | Mass | B31D 1/0062 229/87.01 |
| 2002/0113428 | A1 * | 8/2002 | Phillips | B42D 15/006 283/62 |
| 2006/0134365 | A1 * | 6/2006 | Blank | G09F 3/10 428/42.3 |
| 2006/0263594 | A1 | 11/2006 | Kraft et al. | |
| 2007/0139690 | A1 | 6/2007 | Fukushima | |
| 2010/0156087 | A1 * | 6/2010 | Raming | G09F 3/0288 283/79 |

FOREIGN PATENT DOCUMENTS

| | | | |
|---|---|---|---|
| JP | 2001-031039 | A | 2/2001 |
| JP | 2007-166454 | A | 6/2007 |
| JP | 2008-041048 | A | 2/2008 |
| JP | 2008-257580 | A | 10/2008 |
| JP | 2011-235966 | A | 11/2011 |
| JP | 2013086416 | A * | 5/2013 |
| JP | 2013-111962 | A | 6/2013 |
| JP | 2014-215386 | A | 11/2014 |
| JP | 2014215386 | A * | 11/2014 |
| JP | 2015-009514 | A | 1/2015 |
| WO | 2012/014958 | A1 | 2/2012 |
| WO | 2013/128629 | A1 | 9/2013 |

OTHER PUBLICATIONS

The extended European search report issued by the European Patent Office dated Mar. 24, 2016, which corresponds to European Patent Application No. 15191772.1-1707 and is related to U.S. Appl. No. 14/921,748.

Notification of Transmittal of Translation of the International Preliminary Report on Patentability and Translation of Written Opinion of the International Searching Authority; PCT/JP2016/053855; dated Aug. 24, 2017.

An Office Action issued by the United States Patent and Trademark Office dated May 29, 2018, which corresponds to U.S. Appl. No. 15/549,440 and is related to U.S. Appl. No. 14/921,748.

* cited by examiner

LABEL ISSUING APPARATUS

BACKGROUND OF THE INVENTION

Field of the Invention

The present invention relates to a label issuing apparatus.

Related Background Art

In supermarkets and the like, work of affixing price labels to prepared foods, boxed lunches, and the like is conducted by clerks. Conventionally, such work is performed such that a plurality of labels collectively issued from a label issuing apparatus at a time, and the labels are removed from a mount one by one and are affixed to the boxed lunches and the like arranged on a display table.

In recent years, so-called linerless labels have been used in view of environment aspects. The linerless label is a label without having a liner (release paper) affixed to a sticking surface of the label, so that waste generated by issuing the label can be prevented. JP 2015-009514 A discloses a label issuing apparatus that can print commodity information on such linerless label and issues label pieces.

SUMMARY OF THE INVENTION

Since the liner is not affixed to the label pieces printed on the linerless label by the conventional label issuing apparatus, the issued label pieces cannot be stocked in a linked state, like the conventional label pieces with the liner. Therefore, every time the label is issued, the label needs to be carried and affixed to the individual prepared food, boxed lunch, and the like. Therefore, the affixing work is inefficient.

Therefore, an objective of the present invention is to provide a label issuing apparatus that can issue label pieces made of a linerless label as a series of label pieces linked in a sheet-like shape.

According to the present invention, a label issuing apparatus includes: a print unit configured to print commodity information on a linerless label; a feeding unit configured to feed the linerless label; a cutting unit configured to detach the linerless label as a label piece; and a temporary adhesion unit configured to hold the label piece, and to superimpose an upstream end portion in a feeding direction of the held label piece on a downstream end portion in a feeding direction of a subsequent label, the subsequent label being the linerless label next fed by the feeding unit.

In the label issuing apparatus of this configuration, every time the label piece is detached from the label, a downstream-side end portion (tip end portion) of a subsequent label is superimposed and affixed on an upstream-side end portion (rear end portion) of a preceding label piece. Then, such a superimposed and affixed state is sequentially repeated, so that a series of label pieces linked in a sheet-like shape label can be issued even though the label pieces are made of a linerless label.

In an embodiment, the temporary adhesion unit may hold the label piece from front and back sides, and may superimpose the upstream end portion in a feeding direction of the label piece on the downstream end portion in a feeding direction of the subsequent label, after moving the upstream end portion to a position where the upstream end portion does not hinder progress of the downstream end portion in a feeding direction of the subsequent label.

In an embodiment, the temporary adhesion unit may superimpose a printing surface of the subsequent label on an adhesive surface of the label piece, or may superimpose an adhesive surface of the subsequent label on a printing surface of the label piece, by holding the label piece to be inclined in a direction intersecting with the feeding direction of the label.

In an embodiment, the print unit may start printing after retracting the linerless label detached as the label piece to a print position once.

In an embodiment, a position of the temporary adhesion unit with respect to the feeding unit may be switchably provided in a first direction approximately perpendicular to the feeding direction and to a direction perpendicular to a printing surface of the label piece.

In the label issuing apparatus of this configuration, every time the label piece is detached from the label, a downstream-side end portion (tip end portion) of a subsequent label is superimposed and affixed on an upstream-side end portion (rear end portion) of a preceding label piece. Then, such a superimposed and affixed state is sequentially repeated, so that a series of label pieces linked in a sheet-like shape can be issued even though the label pieces are made of a linerless label. Further, the position of the temporary adhesion unit with respect to the feeding unit is switchably provided in the first direction. Therefore, the label pieces can be linked in a sheet-like shape while being shifted in the first direction in units of piece or in units of several pieces. Accordingly, a user can easily recognize the end portions of the label pieces linked in a sheet-like shape, and thus can easily separate the label piece. As a result, the label pieces generated from the linerless label can be caused to be in an easily separable state, and can be issued as a series of label pieces linked in a sheet-like shape.

In an embodiment, the label issuing apparatus may further include a moving mechanism configured to relatively move the position of the temporary adhesion unit with respect to the feeding unit, and a control unit configured to control the moving mechanism to switch the position of the temporary adhesion unit.

In the label issuing apparatus of this configuration, the label pieces can be linked in a sheet-like shape while being shifted in the first direction in units of piece or in units of several pieces with a simple configuration.

In an embodiment, the control unit may switch the position of the temporary adhesion unit every time one label piece or a plurality of label pieces is detached.

According to the label issuing apparatus of this configuration, the label piece is shifted in the first direction in each piece or in each several pieces. Accordingly, a series of label pieces in which the label pieces shifted in the first direction in each piece or in each several pieces exist can be issued. In this series of label pieces, the user can easily recognize the end portion of the label piece, and thus can easily separate each label piece or each several label pieces.

In an embodiment, the control unit may alternately switch the position of the temporary adhesion unit to a first position and to a second position different from the first position every time one label piece is detached.

According to the label issuing apparatus of this configuration, expansion in the first direction in a series of label pieces linked in a sheet-like shape can be minimized, and the label pieces can be linked in a sheet-like shape while being shifted in the first direction in units of piece with simple control. In this series of label piece, the user can easily recognize the end portion of the label piece, and thus can easily separate each label piece.

In an embodiment, the label issuing apparatus may further include an information acquisition unit configured to acquire the commodity information printed on the label piece, and the control unit may switch the position of the temporary adhesion unit, based on a type of the commodity information acquired by the information acquisition unit.

According to the label issuing apparatus of this configuration, at timing when the commodity information is switched, the label piece is shifted in the first direction. Accordingly, a series of label pieces in a state where a group of the label pieces on which the same commodity information is printed is shifted in the first direction can be issued. In this series of label pieces, each label pieces having the same commodity information can be easily separated.

In an embodiment, the control unit may switch the position of the temporary adhesion unit at both of first timing when one label piece is detached, and second timing when change of the type of the commodity information printed on the label piece is acquired, and a moving amount of the temporary adhesion unit at the second timing may be made larger than a moving amount of the temporary adhesion unit at the first timing.

According to the label issuing apparatus of this configuration, each label piece is shifted in the first direction. Therefore, a series of label pieces with which the user can easily recognize an end portion of each label piece can be issued. Further, the label piece is largely shifted in the first direction at timing when the commodity information is switched. Therefore, a series of label pieces with which the user can easily recognize a group of the label pieces on which the same commodity information is printed can be issued. In this series of label pieces, each label piece, or each label pieces having the same commodity information can be easily separated.

In an embodiment, the print unit may print the commodity information on the linerless label on which a region on which an adhesive is not applied, and extending in a first direction is formed on a sticking surface, and the feeding unit may feed the linerless label along the first direction; and the region may be formed at least one of both end portions of the sticking surface in a second direction approximately perpendicular to the first direction.

In the label issuing apparatus of this configuration, every time the label piece is issued, a downstream-side end portion (tip end portion) of a subsequent label or a subsequent label piece is superimposed and affixed on an upstream-side end portion (rear end portion) of a preceding label piece. Then, such a superimposed and affixed state is sequentially repeated, so that a series of label pieces linked in a sheet-like shape can be issued even though the label pieces are made of a linerless label. Further, the region on which no adhesive is applied is formed on at least one of both end portions in the second direction on the linerless label. Therefore, in a series of label piece, a portion where the label pieces are superimposed via the region on which no adhesive is applied becomes in a rising state, compared with a portion where the label pieces are superimposed via the adhesive. Accordingly, the user can easily recognize the end portions of the label pieces linked in a sheet-like shape, and thus can easily separate the label piece. As a result, the label pieces generated from the linerless label can be caused to be in an easily separable state, and can be issued as a series of label pieces linked in a sheet-like shape.

In an embodiment, a length of the region in the second direction may be 1 to 5 mm.

According to the label issuing apparatus of this configuration, the label piece does not become in an unnatural state when affixed on a commodity, and can be easily separated.

In an embodiment, the adhesive may be intermittently applied on the region along the first direction.

According to the label issuing apparatus of this configuration, mutual separation of the label pieces becomes easy, while adhesion force between the label pieces and adhesion force to an article to be affixed are maintained.

In an embodiment, the print unit may print end portion identification information with which the end portion is identifiable on a position of an end portion in the feeding direction of the label piece.

According to the label issuing apparatus of this configuration, the end portion identification information such as a line or a figure is printed on the end portion in the feeding direction of the label piece. Therefore, the user can more easily recognize the end portions of the label pieces linked in a sheet-like shape.

In an embodiment, the label issuing apparatus may further include an information acquisition unit configured to acquire the commodity information to be printed on the linerless label, wherein, when change of a type of the commodity information has been detected, based on the commodity information acquired by the information acquisition unit, the print unit may print change identification information that indicates that the commodity information has been changed, and/or may change a position where the commodity information is printed, on a position of an end portion in the feeding direction of the label piece.

According to the label issuing apparatus of this configuration, the change identification information such as a line, a color of a figure, or a shape of a figure is printed on the end portion in the feeding direction of the label piece when the commodity information is changed. Therefore, in a series of label pieces linked in a sheet-like shape, the user can easily recognize a place where a different type of label is started.

In an embodiment, the label issuing apparatus may further include a position acquisition unit configured to acquire a position of the region, and the print unit may print the commodity information, avoiding a back surface of the position acquired by the position acquisition unit.

According to the label issuing apparatus of this configuration, disorder of printing due to the commodity information being printed on a gap caused between the region with application of an adhesive, for forming a sticking surface on the linerless label, and the region without application of an adhesive can be suppressed.

According to one aspect of the present invention, label pieces generated from a linerless label can be issued as a series of label pieces linked in a sheet-like shape.

DESCRIPTION OF THE PREFERRED EMBODIMENTS

Figure 1:
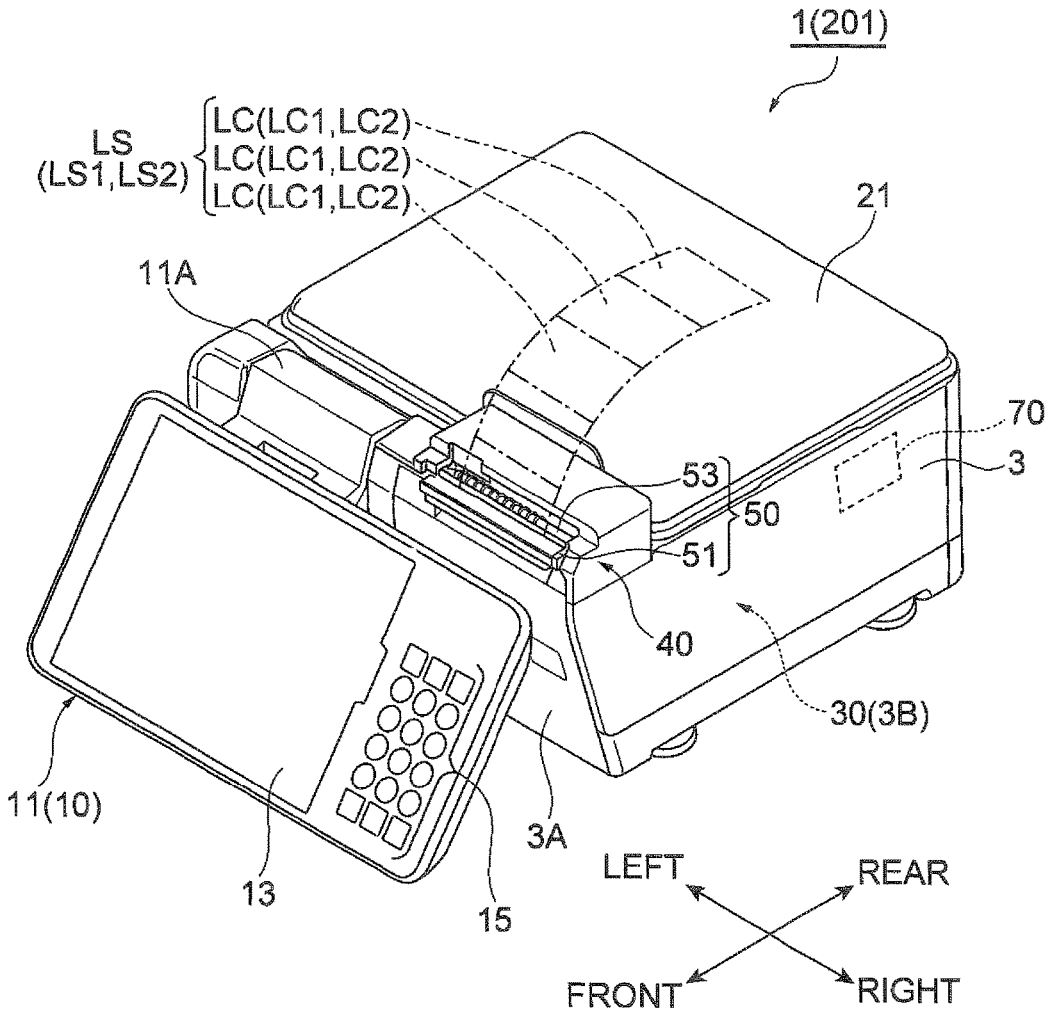
FIG. 1 is an external perspective view of an electronic balance including a label issuing apparatus according to a first embodiment.

Hereinafter, embodiments will be described with reference to the drawings. In description of the drawings, the same element is denoted with the same reference sign, and overlapping description is omitted. Dimensions and ratios of the drawings do not necessarily accord with the description. Note that, in the present specification, for convenience of description, description will be given based on an arrangement in which a side where a clerk-side operation unit 11 is arranged is the "front", a side opposite to the side where the clerk-side operation unit 11 is arranged is the "rear", a left-hand side of when looking at an electronic balance 1 from the front is the "left", and a right-hand side of when looking at the electronic balance 1 from the front side is the "right", as illustrated in FIG. 1. However, this arrangement does not limit the configuration of the present invention.

First Embodiment

Figure 2:
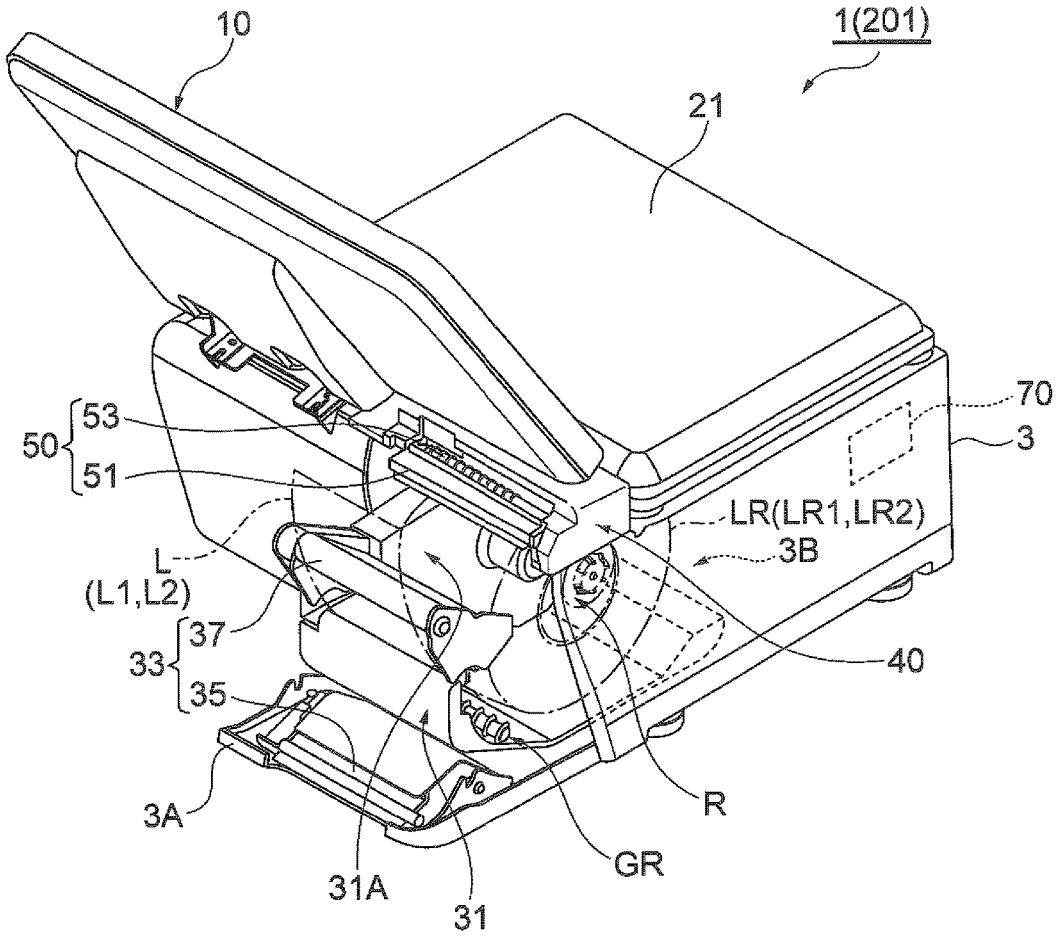
FIG. 2 is an external perspective view illustrating a state where a cover of a mounting portion in the electronic balance of FIG. 1 is opened.

An electronic balance 1 has a function to measure weight of a commodity, and to issue a label piece LC to be affixed on the measured commodity. As illustrated in FIGS. 1 and 2, the electronic balance 1 includes a main body case 3, an operation unit 10 provided on a configuration surface of the main body case 3, a measuring unit 20, a printer unit (label issuing apparatus) 30, and a main body control unit 70 housed in the main body case 3.

The operation unit 10 includes a clerk-side operation unit 11 arranged on a front surface of the main body case 3, and a customer-side operation unit (not illustrated) arranged on a rear surface of the main body case 3. The clerk-side operation unit 11 is rotatably provided having a hinge unit 11A as an axis. The clerk-side operation unit 11 includes a touch panel 13 and fixed keys 15. On the touch panel 13, basic information necessary for an operation of the electronic balance 1 is displayed by control of the main body control unit 70. The fixed keys 15 include a "unit price" key necessary as an electronic charge balance, a "fixed price" key, a "tare" key, a "print" key, a "call" key, and the like, and these keys are appropriately arranged together with numerical keys.

When a user operates the "call" key, and touches an item displayed on the touch panel 13, registered information of a commodity to be measured is read out. Here, when the user places a commodity on a measurement table 21, weight, a price, a commodity name, and the like are displayed on the touch panel 13 of the clerk-side operation unit 11 and a liquid crystal display of the customer-side operation unit. Various advertising messages related to commodities are displayed on the liquid crystal display of the customer-side operation unit, in addition to the weight and the price.

The measuring unit 20 mainly include the measurement table 21, a load cell, a signal processing circuit, and a transmission module (these are not illustrated). The load cell is provided below the measurement table 21, and converts mechanical distortion generated when an article to be measured is placed on the measurement table 21 into an electrical signal. The signal processing circuit amplifies the electrical signal output from the load cell and coverts the amplified signal into a digital signal. The transmission module transmits the digital signal to the main body control unit 70 in the main body case 3 by wireless means.

Figure 5:
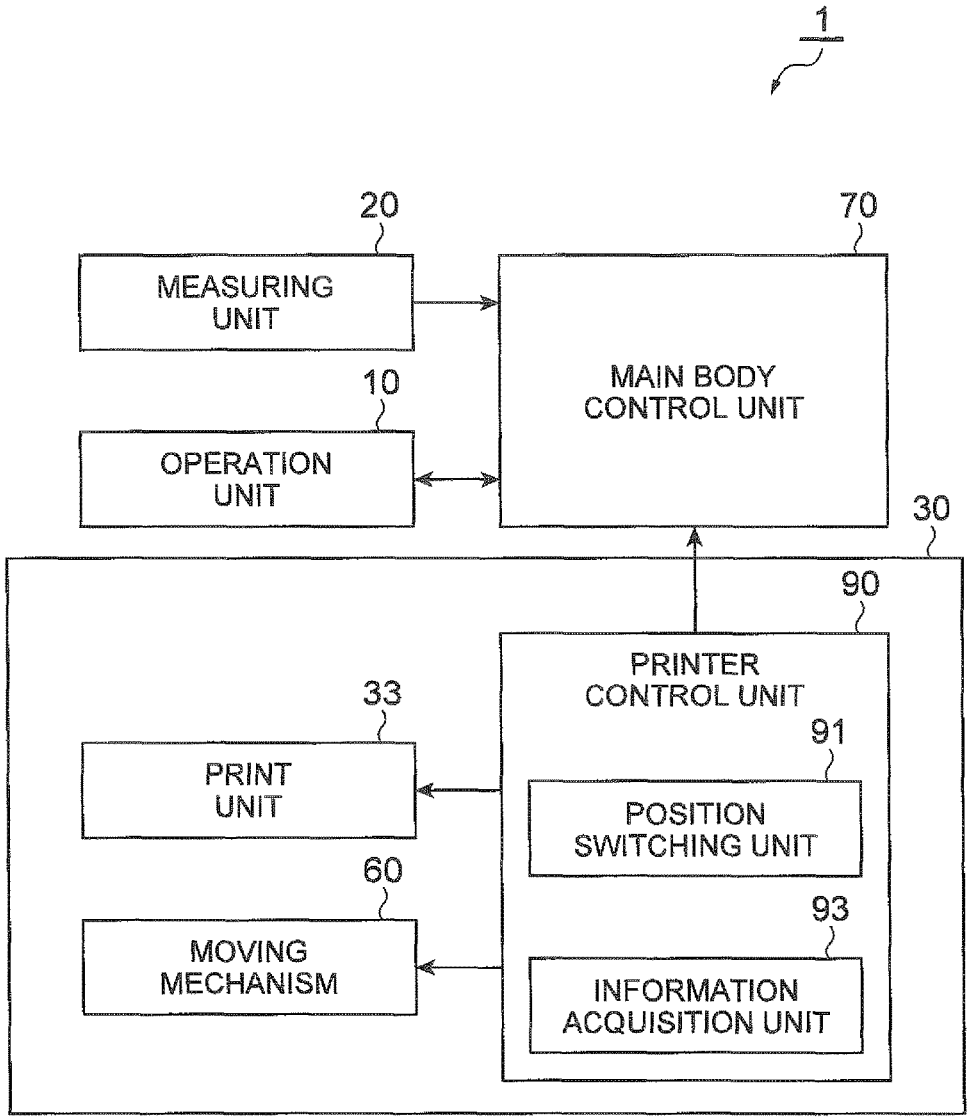
FIG. 5 is a functional block diagram illustrating functional configurations in the electronic balance including the label issuing apparatus according to the first embodiment.

The main body control unit 70 is a part that controls various operations in the electronic balance 1, and a central processing unit (CPU), a read only memory (ROM), and a random access memory (RAM) are mutually connected via a bus line such as an address bus or a data bus. As illustrated in FIG. 5, the main body control unit 70 executes various types of control processing in the electronic balance 1. For example, the main body control unit 70 receives the digital signal transmitted from the measuring unit 20, calculates a price by multiplying mass obtained from the received signal by a unit price per unit mass set in advance, and displays the calculated price on the touch panel 13 of the clerk-side operation unit 11, and on the liquid crystal display of the customer-side operation unit. Note that, in the first embodiment, the signal is transmitted from the measuring unit 20 to the main body control unit 70 by wireless means. However, the signal may be transmitted by wired means instead.

Figure 3:
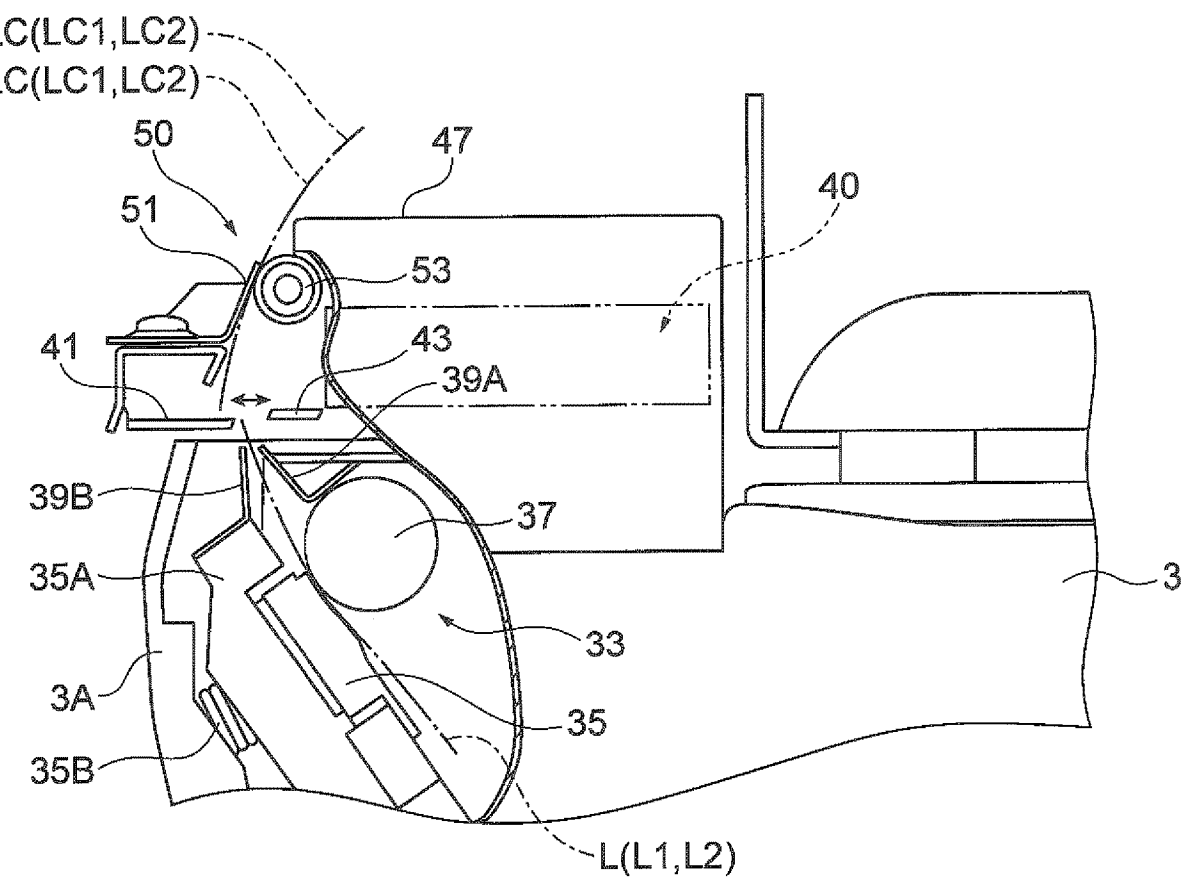
FIG. 3 is a unital view enlarging and illustrating principal part of a printer unit of FIG. 1.

As illustrated in FIGS. 1 to 3, the printer unit 30 is arranged behind a swing door 3A provided on the right side of the front surface of the main body case 3. The swing door 3A is openably/closably provided by being rotated around a lower end as an axis. The printer unit 30 is arranged to be exposed when the swing door 3A is in an open state. The printer unit 30 includes a cassette unit 31, a print unit 33, a cutter unit (cutting unit) 40, a temporary adhesion unit 50, a moving mechanism 60, and a printer control unit 90.

The cassette unit 31 freely attachably/detachably support a label roll LR. A roll support portion R that can support the label roll LR in a cantilever state is formed on a side wall 31A of the cassette unit 31, as illustrated in FIG. 2, and the label roll LR is mounted to the roll support portion R.

Here, the label roll LR will be described. The label roll LR is formed such that so-called a linerless label L is wound around a paper tube and formed in a roll manner. In the linerless label L (hereinafter, simply referred to as "label L"), an adhesive is applied on a rear surface of a sheet that is a base material, a heat sensitizer that develops a color by heat is applied on a surface, and a silicone resin as a release agent is further applied on the surface. The label roll LR is obtained such that the label L is wound around the paper tube with the rear surface (sticking surface) of the label L facing an inside. The linerless label L pulled out from the paper tube is passed on to an upper platen roller (feeding unit) 37 via a guide roller GR attached to the side wall 31A of the cassette unit 31 in a cantilever state. The linerless label L is passed such that the rear surface comes in contact with the platen roller (feeding unit) 37.

As illustrated in FIG. 3, the print unit 33 includes a print head (print unit) 35 and the platen roller 37.

The print head 35 is provided on a rear surface of the swing door 3A, and prints the commodity information on the label L. The print head 35 is configured from a thermal-type print head. The print head 35 is positioned to come in contact with the platen roller 37 when the swing door 3A is closed. To be specific, the print head 35 is fixed to a support frame 35A, which is attached to the swing door 3A to approach/separate from the swing door 3A via a hinge (not illustrated). Further, a spring 35B that biases the print head 35 in a direction of pressing the print head 35 against the platen roller 37 when the swing door 3A is closed is provided between the support frame 35A and the swing door 3A.

The platen roller 37 is arranged to face a position of the print head 35 of when the swing door 3A is closed. The platen roller 37 feeds the label L on which the commodity information is printed by the print head 35. A first guide plate 39A that restricts a moving path of the printed label L is attached above the platen roller 37. As illustrated in FIG. 2, a gear mechanism (not illustrated) that drives the platen roller 37 is incorporated in the side wall 31A of the cassette unit 31. When the cassette unit 31 is mounted on a mounting portion 3B of the main body case 3, the gear mechanism is connected with a drive motor, and the platen roller 37 is driven and rotated.

Meanwhile, a second guide plate 39B that restricts the moving path of the printed label L is attached above the print head 35 (attached to a tip end portion of the support frame 35A of the swing door 3A side). The first guide plate 39A and the second guide plate 39B are arranged to face each other to be gradually narrowed in a direction of feeding the label L when the swing door 3A is closed. The label L is fed from one of tip end portions where a gap between the first guide plate 39A and the second guide plate 39B becomes narrow.

The cutter unit 40 detaches the label L fed from the print unit 33, as a label piece LC (see FIG. 1) having a predetermined length. The cutter unit 40 is attached to an upper portion of the pair of guide plates 39A and 39B, and the platen roller 37. Further, the cutter unit 40 is attached to an upper portion of the main body case 3. The cutter unit 40 includes a fixed blade 41 and a movable blade 43. In the cutter unit 40, the movable blade 43 is connected with a crank mechanism inside the cutter unit 40, and reciprocates between the own blade and the fixed blade 41 at a high speed in a horizontal direction.

The temporary adhesion unit 50 holds the label L from the front and rear sides, when the label piece LC is detached from the label L by the cutter unit 40. Further, the temporary adhesion unit 50 retracts a rear end portion (an upstream end portion in the feeding direction) of the label piece LC to a position where the rear end portion does not come in contact with a front end portion (a downstream end portion in the feeding direction) of a subsequently fed label L, as well as holding the label piece LC detached by the cutter unit 40 from the front and rear sides. The temporary adhesion unit 50 mainly includes a pressing member 51 that slightly presses the label L against the surface of the temporary adhesion unit 50, and a holding roller 53.

The pressing member 51 is a member arranged to slightly press the printed label L against the holding roller 53, and is formed of a thin resin plate.

Figure 4A:
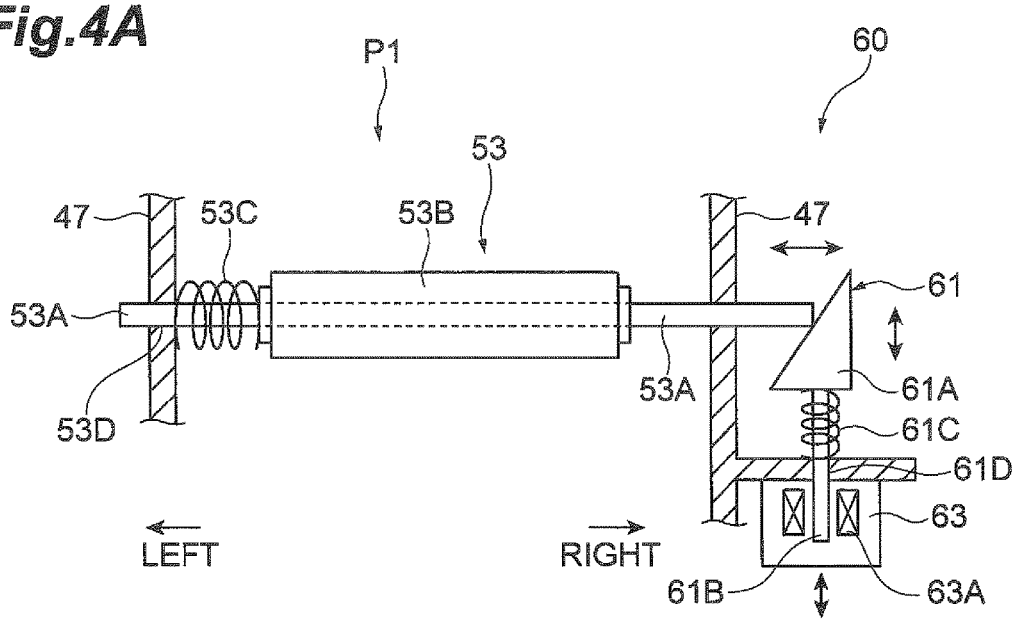
FIG. 4A is a diagram illustrating a schematic configuration of a moving mechanism included in the printer unit of FIG. 1, and is a diagram illustrating a case where a holding roller is positioned in a first position.
Figure 4B:
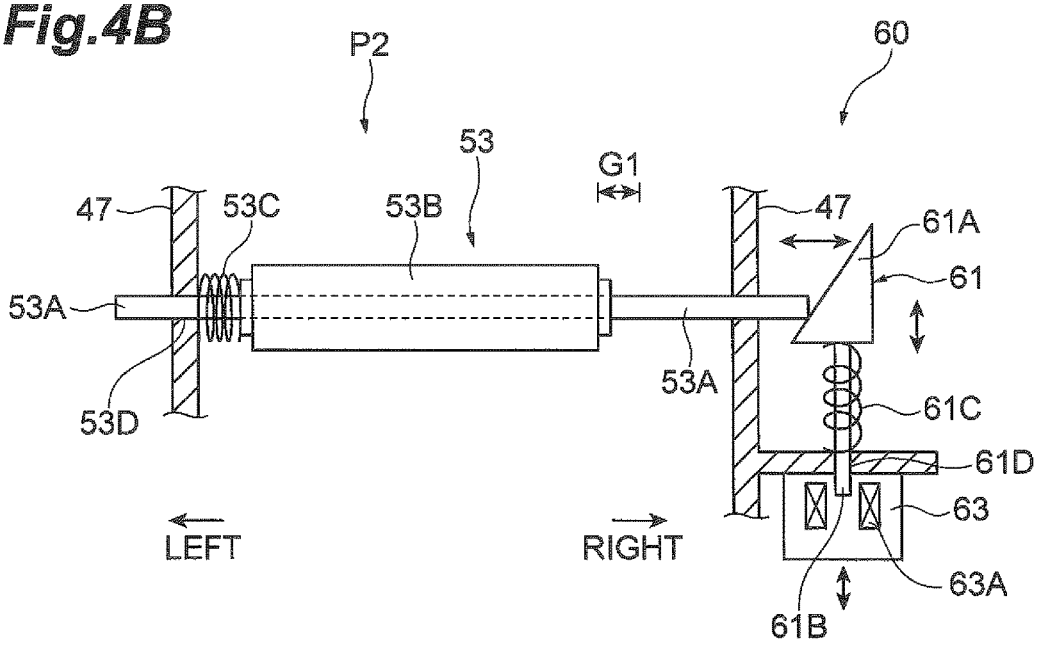
FIG. 4B is a diagram illustrating a schematic configuration of the moving mechanism included in the printer unit of FIG. 1, and is a diagram illustrating a case where the holding roller is positioned in a second position.

As illustrated in FIGS. 3, 4A, and 4B, the holding roller 53 includes an axis portion 53A, a roller portion 53B, and a spring 53C. The roller portion 53B is rotatably provided to the axis portion 53A. Both ends of the axis portion 53A are supported by a cover case 47 that covers the cutter unit 40. Between one support portion 53D and the roller portion 53B, of support portions between the cover case 47 and the axis portion 53A, the spring 53C that biases the holding roller 53 in a direction being away from the support portion 53D is arranged. With this configuration, even if force is applied to the axis portion 53A toward the one support portion 53D side, and the holding roller 53 is moved toward the one support portion 53D side, the holding roller 53 can be restored to a former position before the force is applied, when the force is removed.

A peripheral surface of the holding roller 53 is formed in an uneven manner in order to decrease a contact area with the sticking surface of the label L. In the first embodiment, the pressing member 51 and the holding roller 53 are fixed to the cover case 47 that covers the cutter unit 40. However, the temporary adhesion unit 50 may be formed into a unit and the unit can be caused to approach/separate from the cutter unit 40.

The moving mechanism 60 relatively moves the position of the temporary adhesion unit 50 with respect to the print unit 33 in a first direction (the right and left direction illustrated in FIG. 1) that is perpendicular to the feeding direction of the label L and to a direction perpendicular to a printing surface of the label. To be specific, as illustrated in FIGS. 4A and 4B, the moving mechanism 60 includes a pushing portion 61 and a solenoid 63, and is arranged on the right hand side of the holding roller 53 in the temporary adhesion unit 50.

The pushing portion 61 includes a contact portion 61A, an axis portion 61B, and a spring 61C. The contact portion 61A comes in contact with the other end portion of the axis portion 53A. One end portion of the axis portion 61B comes in contact with the contact portion 61A, and the other end portion is connected to the solenoid 63 via a support portion 61D. In the axis portion 61B, between the contact portion 61A and the support portion 61D, the spring 61C that biases the contact portion 61A in a direction of being away from the support portion 61D is arranged.

The solenoid 63 is a drive unit of the pushing portion 61. The solenoid 63 linearly drives the axis portion 61B when a coil 63A included in the solenoid 63 is energized. To be specific, the solenoid 63 drives the axis portion 61B in an up and down direction illustrated in FIGS. 4A and 4B, and when the coil 63A is energized, the solenoid 63 moves the axis portion 61B downward.

When the coil 63A of the solenoid 63 is energized, the axis portion 61B is drawn downward, and the pushing portion 61 is moved downward. The axis portion 53A of the holding roller 53, which is in contact with the pushing portion 61, is moved in the right direction along the contact portion 61A by biasing force of the spring 53C. That is, the holding roller 53 is moved to a relatively right-side first position P1, as illustrated in FIG. 4A.

Meanwhile, when the energization to the coil 63A of the solenoid 63 is ceased, the action to draw the axis portion 61B downward is ceased, and the pushing portion 61 is moved upward by biasing force of the spring 61C. The axis portion 53A of the holding roller 53, which is in contact with the pushing portion 61, is pushed in the left direction along the contact portion 61A. That is, the holding roller 53 is moved to a relatively-left second position P2, as illustrated in FIG. 4B. With such a configuration of the moving mechanism 60, the temporary adhesion unit 50 can be moved to the first position P1 and the second position P2, in the first direction (the right and left direction illustrated in FIG. 4A) that is perpendicular to the feeding direction of the label L and to the direction perpendicular to the printing surface of the label L.

The printer control unit 90 is a part that controls various operations in the printer unit 30, and a CPU, a ROM, and a RAM are mutually connected via a bus line such as an address bus or a data bus. As illustrated in FIG. 5, the printer control unit 90 includes a position switching unit (control unit) 91 as a conceptual part that executes various types of control processing in the printer unit 30. Such a conceptual part is realized such that a program stored in the ROM is loaded to the RAM, and is executed by the CPU.

The position switching unit 91 is a part that controls the moving mechanism 60 to switch the position of the holding roller 53. The position switching unit 91 of the first embodiment alternately switches the position of the holding roller 53 to the first position P1 (see FIG. 4A) and to the second position P2 (see FIG. 4B) every time one label piece LC is detached from the label L. Note that "every time the label piece is detached" referred here is a concept that includes not only switching at the same time as the detachment, but also switching before the holding roller 53 that holds the preceding label piece LC holds the subsequently fed label L.

Next, an operation of the printer unit 30 that is one characteristic part of the first embodiment will be described using FIGS. 6A to 6C. The label L used here has the printing surface on the upper side, and the sticking surface on the lower side. For example, when the user operates the "print" key, the platen roller 37 is reversely rotated, and the platen roller 37 retracts the label L fed to the position of the cutter unit 40, and puts the tip end of the label L back to the position of the print head 35. Following that, the print head 35 prints the weight, the price, the commodity information, and the like on the label L in a predetermined format, the label L being fed by rotation of the platen roller 37 in a forward direction.

The label L is fed while being printed the commodity information by the print head 35 and the platen roller 37. In other words, the print unit 33 is a part that prints and also feeds the label L. The label L on which the commodity information is printed is cut by the cutter unit 40 in a state where the front and rear sides are held by the temporary adhesion unit 50, and becomes the label piece LC (hereinafter, referred to as "preceding label piece LC"). Accordingly, as illustrated in FIG. 6A, the preceding label piece LC becomes in a state where the front and rear sides are held by the temporary adhesion unit 50.

At this time, the temporary adhesion unit 50 slightly hold the front and rear sides of the preceding label piece LC with the upper-side pressing member 51 and the lower-side holding roller 53, and holds the preceding label piece LC in a posture where the tip end of the preceding label piece LC is inclined downward (front lowered posture) so that the rear end portion of the preceding label piece LC does not hinder the progress of the tip end portion of a subsequently fed label L (hereinafter, referred to as "subsequent label L"). To be specific, a contact position of the pressing member 51 and the holding roller 53 is set to a slightly forward position than a rotation center of the holding roller 53. Therefore, when the preceding label piece LC is held between the pressing member 51 and the holding roller 53, the rear end portion of the preceding label piece LC is flipped up, and the rear end portion is moved to the position where the rear end portion does not hinder the progress of the subsequent label L, that is, in a direction perpendicular to the printing surface. The preceding label piece LC is flexible and rigid by the application of the release agent on the printing surface. Therefore, when the preceding label piece LC is simply held in the front lowered posture, the rear end portion can be flipped up.

If the rear end portion of the preceding label piece LC hangs lower than the tip end portion of the subsequent label L, and hinders the progress of the subsequent label L, the temporary adhesion unit 50 may be moved closer to the cutter unit 40 side to make the length of the hanging short. Further, the contact position of the pressing member 51 and the holding roller 53 may be adjusted, and the front lowered posture of the preceding label piece LC may be adjusted to become steeper. Further, the cutter unit 40 with the fixed blade 41 on the upper side and the movable blade 43 on the lower side is used, and when the lower-side movable blade 43 rises and cuts the label L, the movable blade 43 may flip up the rear end portion of the preceding label piece LC, and forcibly move the rear end position of the preceding label piece LC to a position where the rear end portion does not hinder the progress of the tip end portion of the subsequent label L. Further, at the time of restoration of the movable blade 43, if there is a possibility that the flipped rear end portion hangs downward again, air may be blown against the rear end portion, or a linear member that hangs the flipped rear end portion may be provided near the fixed blade 41 so that the rear end portion of the preceding label piece LC can be reliably held to the position where the rear end position does not hinder the progress of the tip end portion of the subsequent label L.

After the label L detached from the preceding label piece LC is pulled back to the position of the print head 35 by rotation in the reverse direction of the platen roller 37, the label L is printed while being fed by the rotation in the forward direction again. Then, when a position that becomes the rear end of the next label piece arrives at the cutter unit 40, the feeding of the label L is stopped at that moment, and the cutter unit 40 is then operated and cuts the label L. As described above, the label L is once pulled back, and is then fed and printed.

Figure 6A:
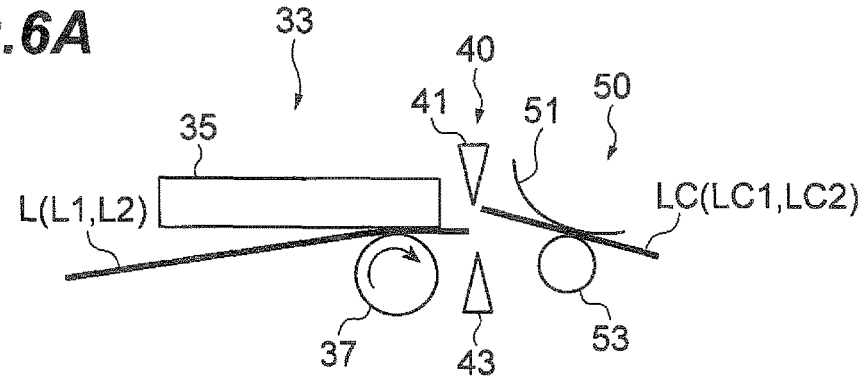
FIG. 6A is a diagram illustrating a state of label pieces in the printer unit.
Figure 6B:
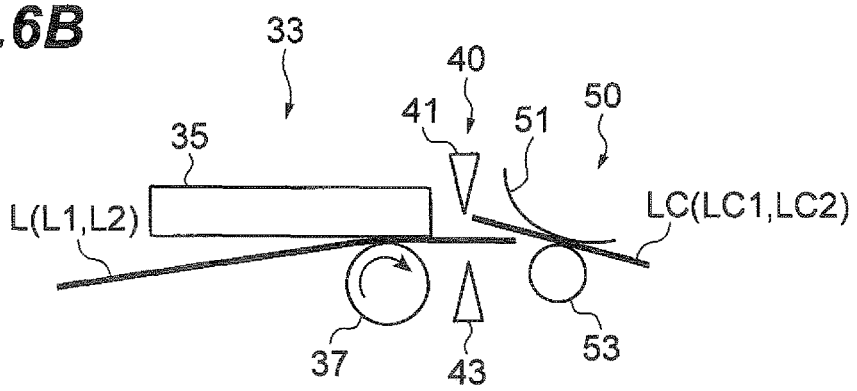
FIG. 6B is a diagram illustrating a state of label pieces in the printer unit.

FIG. 6B illustrates a state where the tip end portion of the subsequent label L gets under the rear end portion of the flipped preceding label piece LC. When the tip end portion of the subsequent label L gets under the rear end portion of the preceding label piece LC, and comes in contact with the sticking surface of the preceding label piece LC, the subsequent label L and the preceding label piece LC adhere to each other in the up and down direction. Under that state, the subsequent label L is further fed, and the preceding label piece LC is pushed by the subsequent label L, and fed from the temporary adhesion unit 50. A position of the subsequent label L, the position becoming the rear end portion of the label piece LC, is then cut by the cutter unit 40, in a state of being held by the temporary adhesion unit 50 in the up and down direction.

Figure 6C:
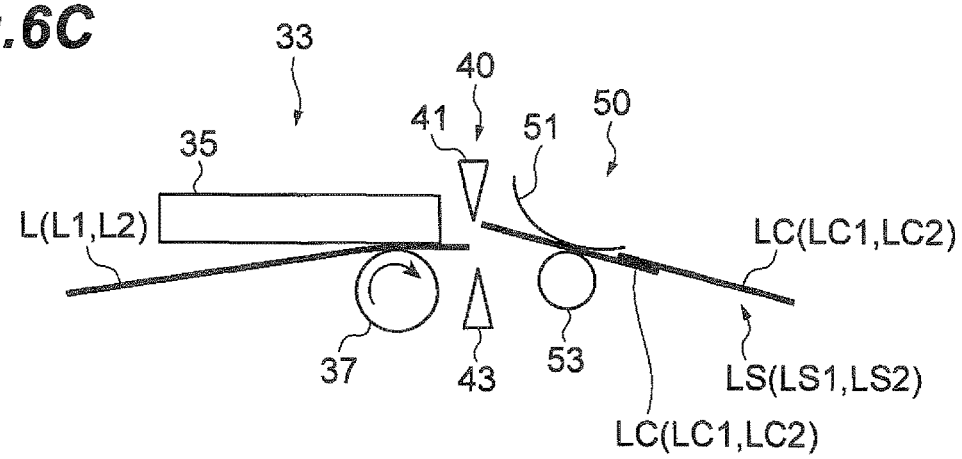
FIG. 6C is a diagram illustrating a state of label pieces in the printer unit

FIG. 6C illustrates a state where the subsequent label L is separated from the label L by the cutter unit 40, and becomes the label piece LC. When the label piece LC is separated from the subsequent label L, the label piece LC becomes in the front lowered posture by being held by the pressing member 51 and the holding roller 53, and the rear end portion is flipped up similarly to the above description.

The above-described operation is repeated, and the tip end portions of the subsequent labels L are joined to the rear end portions of the preceding label pieces LC one after another. Therefore, the label pieces LC detached from the linerless labels L can be issued as a series of label pieces (hereinafter, referred to as "label piece sheet LS") linked in in a sheet-like shape.

FIGS. 6A to 6C illustrate a case where the printing surface of the subsequent label L is partially superimposed on the sticking surface of the preceding label piece LC. However, a label piece sheet LS obtained such that the sticking surface of the subsequent label L is partially superimposed on the printing surface of the preceding label piece LC may be issued. Next, an example of partially superimposing the sticking surface of the subsequent label L on the printing surface of the preceding label piece LC will be described using FIGS. 7A to 7C.

Figure 7A:
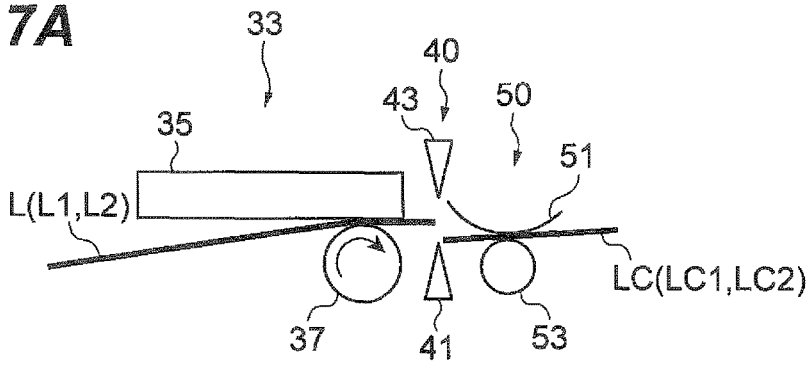
FIG. 7A is a diagram illustrating a state of label pieces in the printer unit.

The label L on which the commodity information is printed is cut by the cutter unit 40 in a state where the front and rear sides are held by the temporary adhesion unit 50, and becomes the label piece LC. Accordingly, as illustrated in FIG. 7A, the preceding label piece LC becomes in the state where the front and rear sides are held by the temporary adhesion unit 50.

At this time, the temporary adhesion unit 50 slightly holds the front and rear sides of the preceding label piece LC with the upper-side pressing member 51 and the lower-side holding roller 53, and holds the preceding label piece LC in a posture where the rear end portion of the preceding label piece LC is inclined downward (rear lowered posture) so that the rear end portion of the preceding label piece LC does not hinder the progress of the tip end portion of the subsequent label L. To be specific, the contact position of the pressing member 51 and the holding roller 53 is set to a slightly backward position than the rotation center of the holding roller 53. Therefore, when the preceding label piece LC is held between the pressing member 51 and the holding roller 53, the rear end portion of the preceding label piece LC is inclined downward, and the rear end portion is moved to a position where the rear end portion does not hinder the progress of the subsequent label L, that is, in the direction perpendicular to the printing surface. The preceding label piece LC is flexible and rigid by the application of the release agent on the printing surface. Therefore, when the preceding label piece LC is simply held in the rear lowered posture, the rear end portion can be lowered.

When the sticking surface of the subsequent label L is partially superimposed on the printing surface of the preceding label piece LC, it is favorable that an upper end of the holding roller 53 is positioned lower than the tip end portion of the subsequent label L. Further, in this case, it is favorable that the movable blade 43 in the cutter unit 40 is arranged to the upper side of a conveyance surface and the fixed blade 41 is arranged to the lower side of the conveyance surface.

Figure 7B:
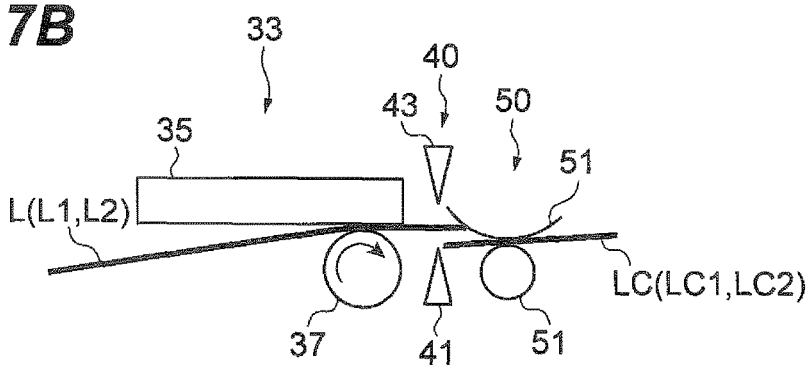
FIG. 7B is a diagram illustrating a state of label pieces in the printer unit.

FIG. 7B illustrates a state where the tip end portion of the subsequent label L is superimposed on the rear end portion of the preceding label piece LC, which is inclined downward. When the tip end portion of the subsequent label L is superimposed on the rear end portion of the preceding label piece LC, and comes in contact with the sticking surface of the preceding label piece LC, the subsequent label L and the preceding label piece LC adhere to each other in the up and down direction. Under that state, the subsequent label L is further fed, and the preceding label piece LC is pushed by the subsequent label L and fed from the temporary adhesion unit 50. A position of the subsequent label L, the position becoming the rear end portion of the label piece LC, is then cut by the cutter unit 40, in a state of being held by the temporary adhesion unit 50 in the up and down direction.

Figure 7C:
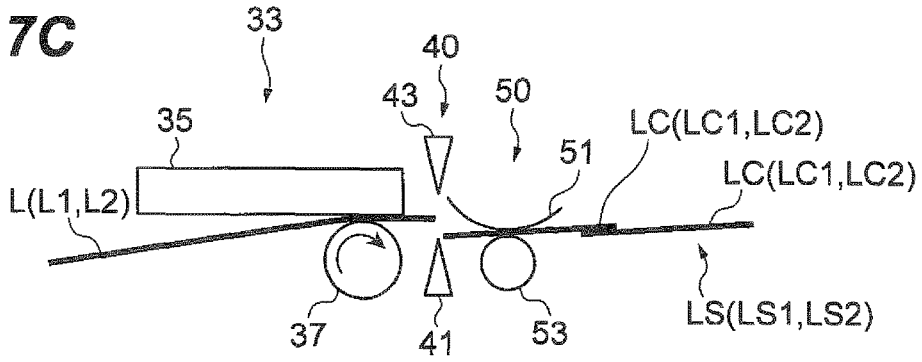
FIG. 7C is a diagram illustrating a state of label pieces in the printer unit

FIG. 7C illustrates a state where the subsequent label L is detached from the label L by the cutter unit 40, and becomes the label piece LC. When the label piece LC is detached from the subsequent label L, the label piece LC becomes in the rear lowered posture by being held by the pressing member 51 and the holding roller 53, and the rear end portion is lowered, similarly to the above description.

Figure 8A:
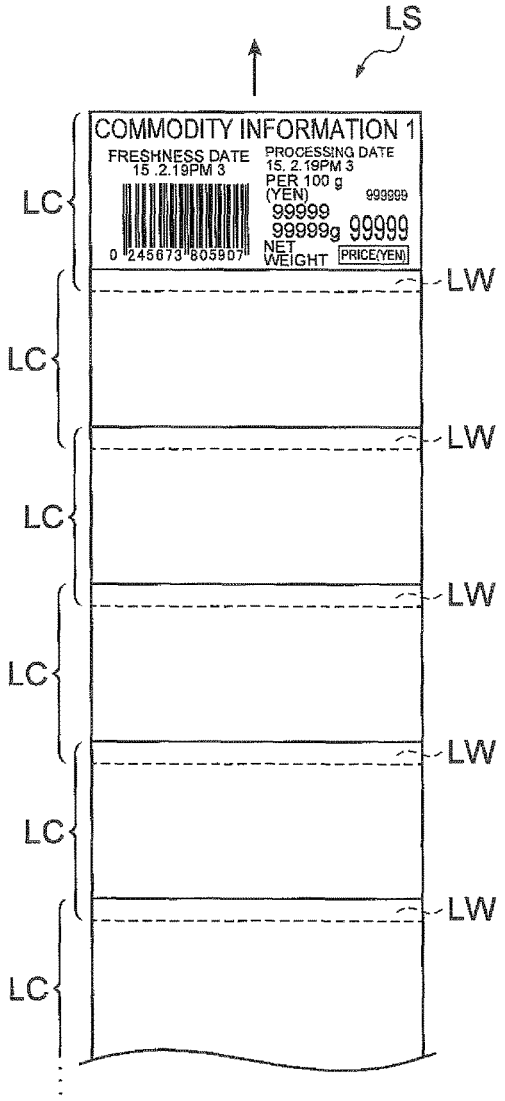
FIG. 8A is a plan view illustrating a label piece sheet issued by the label issuing apparatus according to the first embodiment.
Figure 8B:
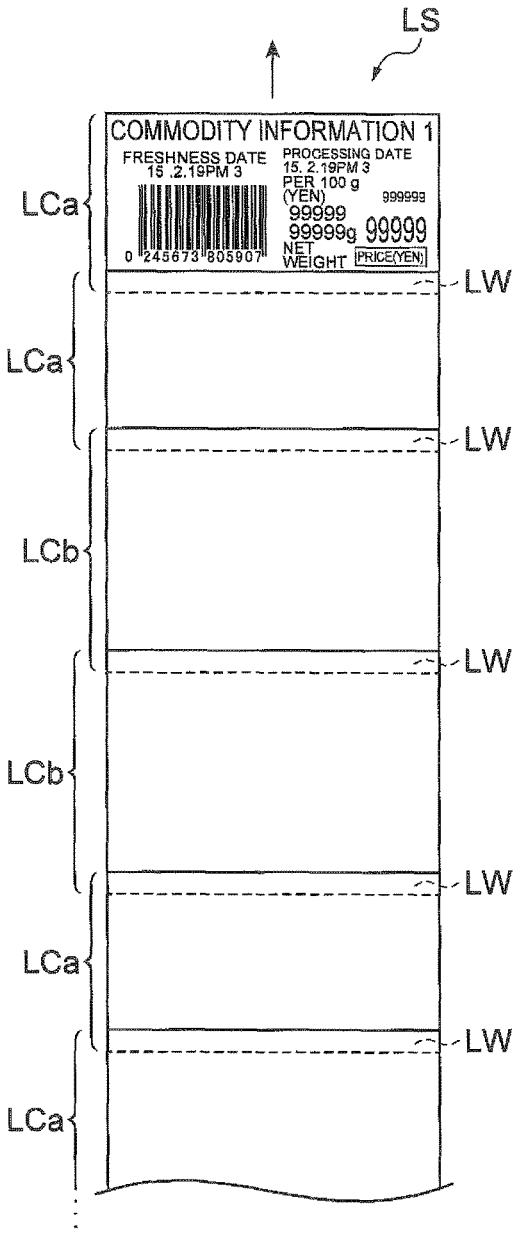
FIG. 8B is a plan view illustrating a label piece sheet issued by the label issuing apparatus according to the first embodiment.

FIGS. 8A and 8B illustrate the label piece sheets LS issued by partial superimposition of the sticking surface of the subsequent label L on the printing surface of the preceding label piece LC. The directions of the arrows respectively illustrated in FIGS. 8A and 8B indicate a direction of being fed from the printer unit 30.

In the label piece sheet LS, the downstream-side end portion (tip end portion) of the subsequently detached label piece LC is superimposed and affixed on the upstream-side end portion (rear end portion) of the precedingly detached label piece LC. It is favorable to appropriately set the size of a superimposed and affixed region (superimposing margin) LW based on the size of the label piece LC. Such a superimposed and affixed state is sequentially repeated, so that the label piece sheet LS is linked in a sheet-like shape.

The label piece sheet LS of FIG. 8B is different from the label piece sheet LS of FIG. 8B in that a label piece LCa and a label piece LCb having mutually different lengths in the feeding direction are included. In the first embodiment, the label piece sheet LS as illustrated in FIGS. 8A and 8B can be issued. Further, the first embodiment is new in that the label piece sheet LS (see FIG. 8B) in which the plurality of label pieces LC (LCa and LCb) is linked in a sheet-like shape can be issued while making use of the advantage of the linerless label L that the length of the label piece LC in the feeding direction can be freely changed according to the commodity information to be printed.

Further, in the printer unit 30 in the first embodiment, every time the label L on which the commodity information is printed is detached as the label piece LC by the cutter unit 40, the position of the temporary adhesion unit 50 with respect to the print unit 33 is relatively moved to the first direction (the right and left direction illustrated in FIG. 1)

perpendicular to the feeding direction of the label L and to the direction perpendicular to the printing surface of the label. Hereinafter, the first direction is described as the right and left direction. To be specific, the position switching unit 91 (see FIG. 5) in the printer control unit 90 controls the moving mechanism 60, and alternately switches the position of the holding roller 53 to the first position P1 (see FIG. 4A) and to the second position P2 (see FIG. 4B) every time the label L is detached as the label piece LC. Note that a moving amount of the holding roller 53 from the first position P1 to the second position P2 is a distance G1 (for example, 1 to 5 mm).

Figure 9:
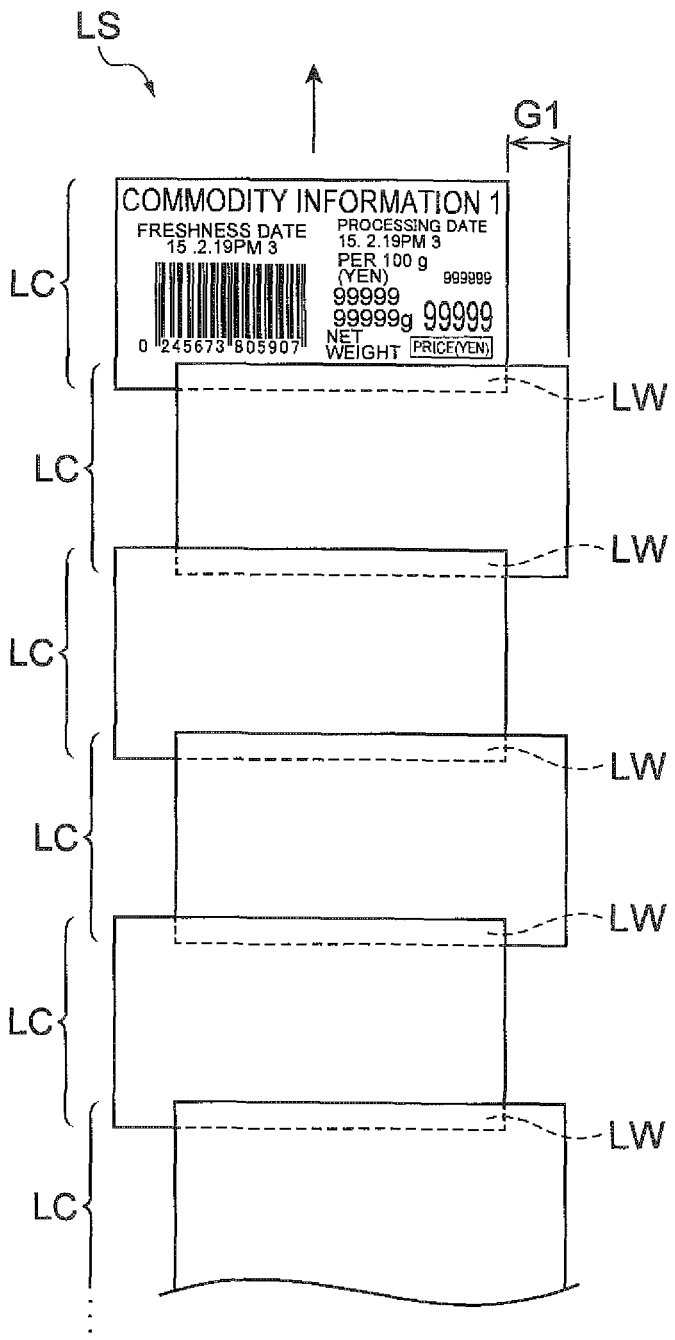
FIG. 9 is a plan view illustrating a label piece sheet issued by the label issuing apparatus according to the first embodiment.

With such movement of the temporary adhesion unit 50, the label piece LC held by the temporary adhesion unit 50 is moved in the right and left direction by the distance G1, Therefore, the downstream-side end portion (tip end portion) of the subsequent label L is superimposed and affixed on the upstream-side end portion (rear end portion) of the preceding label piece LC in a state of being shifted in the right and left direction by the distance G1. FIG. 9 illustrates the label piece sheet LS issued when such a superimposed and affixed state is continued. That is, the printer unit 30 in the electronic balance 1 of the first embodiment can issue the label piece sheet LS superimposed and affixed in a state where the label pieces are alternately shifted in the right and left direction.

In the printer unit 30 of the first embodiment, every time the label piece LC is issued, the downstream-side end portion (tip end portion) of the subsequent label L is superimposed and affixed on the upstream-side end portion (rear end portion) of the preceding label piece LC. Then, such a superimposed and affixed state is sequentially repeated, so that a series of label pieces (label piece sheet LS) linked in a sheet-like shape can be issued even though the label pieces LC are made of the linerless label L. Further, the position of the temporary adhesion unit 50 with respect to the print unit 33 is switchably provided in the right and left direction. Therefore, the label pieces LC can be linked in a sheet-like shape while being shifted in the right and left direction in units of piece or in units of several pieces. Accordingly, the end portion of the label piece LC of the label piece sheet LS can be easily recognized by the user, and thus the label piece LC can be easily separated from the label piece sheet LS. As a result, the label piece LC generated from the linerless label L can be caused to be in an easily separable state, and can be issued as the label piece sheet LS.

In the printer unit 30 of the first embodiment, the position switching unit 91 in the printer control unit 90 controls the moving mechanism 60, and alternately switches the position of the holding roller 53 to the first position P1 and to the second position P2 every time the label piece LC is detached from the label L. Accordingly, expansion in the right and left direction can be minimized, and the label piece sheet LS in which the label pieces LC are shifted in units of piece in the right and left direction can be issued with simple control. With this label piece sheet LS, the user can easily recognize the end portion of the label piece LC, and thus can easily separate the label piece LC from the label piece sheet LS.

The first embodiment has been described. However, the present invention is not limited to the above embodiment, and various changes can be made without departing from the gist of the invention.

First Modification

In the first embodiment, an example in which the holding roller 53 in the temporary adhesion unit 50 is configured to be movable to the first position P1 and to the second position P2 in the right and left direction has been described. However, the present invention is not limited to the embodiment. For example, the holding roller 53 in the temporary adhesion unit 50 may be configured to be movable in multi stages, instead of the two stages of the first position P1 and the second position P2. A configuration of a moving mechanism 160 of this case will be described using FIG. 10.

Figure 10:
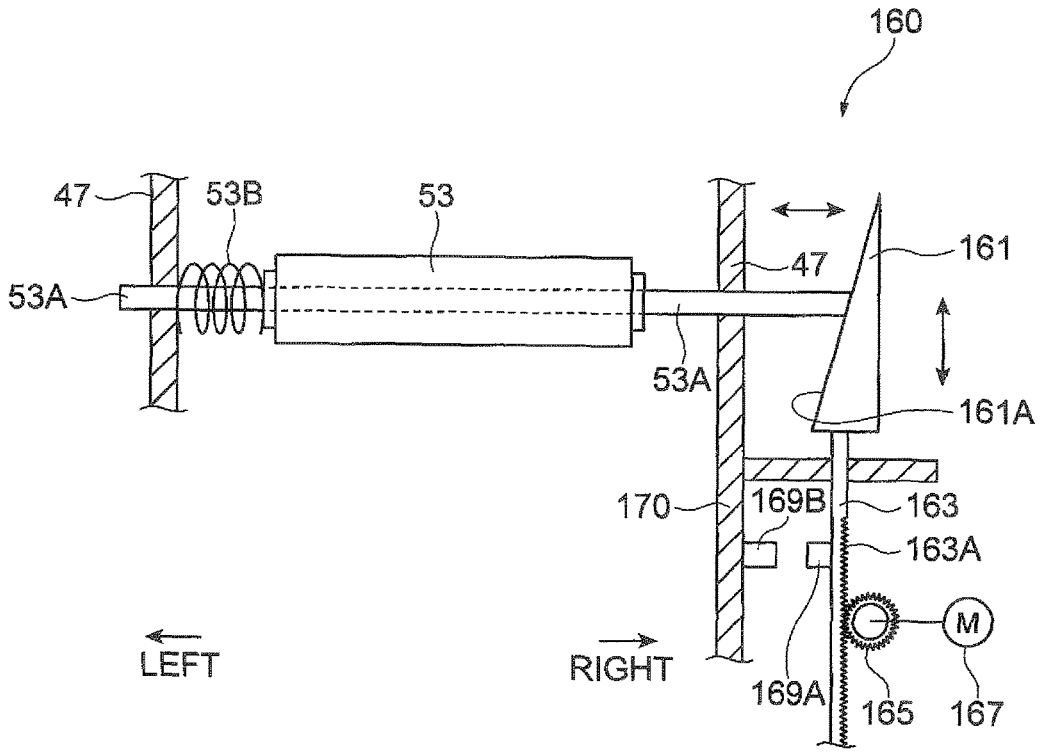
FIG. 10 is a schematic configuration diagram of a moving mechanism included in a printer unit according to a modification of the first embodiment.

The moving mechanism 160 is common to the moving mechanism 60 in that a position of a temporary adhesion unit 50 with respect to a print unit 33 is relatively moved in a right and left direction. As illustrated in FIG. 10, the moving mechanism 160 includes a pushing portion 161, a rack portion 163, a pinion portion 165, a motor 167, and a position acquisition unit 169. Note that a configuration of a holding roller 53 is similar to the first embodiment, and thus description is omitted.

The pushing portion 161 comes in contact with the other end portion of an axis portion 53A. In the pushing portion 161, a contact surface 161A that comes in contact with the axis portion 53A is inclined downward to the left, and pushes the axis portion 53A to the left following movement of the pushing portion 161 to an up direction. The rack portion 163 is movably supported by a support portion 170. The rack portion 163 is a rod-like member with one end portion being connected to the pushing portion 161, and is integrally movable with the pushing portion 161. Teeth 163A is formed in the rack portion 163, the teeth 163A are meshed with teeth of the pinion portion 165 driven and rotated by the motor 167. An example of the motor 167 includes a stepping motor. The rack portion 163 and the pinion portion 165 configure rack and pinion, and rotational force in the motor 167 is converted into movement of the pushing portion 161 in the up and down direction.

The position acquisition unit 169 includes a detection plate 169A provided on the rack portion 163 and a sensor 169B provided on a fixed portion. A plurality of the sensors 169B may be arranged along a moving direction of the rack portion 163. When the sensor 169B detects the detection plate 169A, the position acquisition unit 169 acquires a position of the pushing portion 161 in the up and down direction with respect to the support portion 170.

With such a configuration of the moving mechanism 160, when the motor 167 is driven, and the rack portion 163 is moved downward, the pushing portion 161 is also moved downward. The axis portion 53A of the holding roller 53 that comes in contact with the pushing portion 161 is moved in the right direction along the contact surface 161A by biasing force of a spring 53C. That is, the holding roller 53 is relatively moved to the right side. Meanwhile, when the rack portion 163 is moved upward, the pushing portion 161 is also moved upward. The axis portion 53A of the holding roller 53 that comes in contact with the pushing portion 161 is pushed in the left direction along the contact surface 161A. That is, the holding roller 53 is relatively moved to the left side. Further, a position of the rack portion 163 in the up and down direction can be acquired by the position acquisition unit 169. Therefore, in conjunction with that, a position in the right and left direction of the holding roller 53, which is moved in the right and left direction, can also be acquired. With such a configuration of the moving mechanism 160, the temporary adhesion unit 50 can be movable in multi stages in the right and left direction illustrated in FIG. 10 (a first direction perpendicular to a feeding direction of a label L and to a direction perpendicular to a printing surface of the label L).

Figure 11:
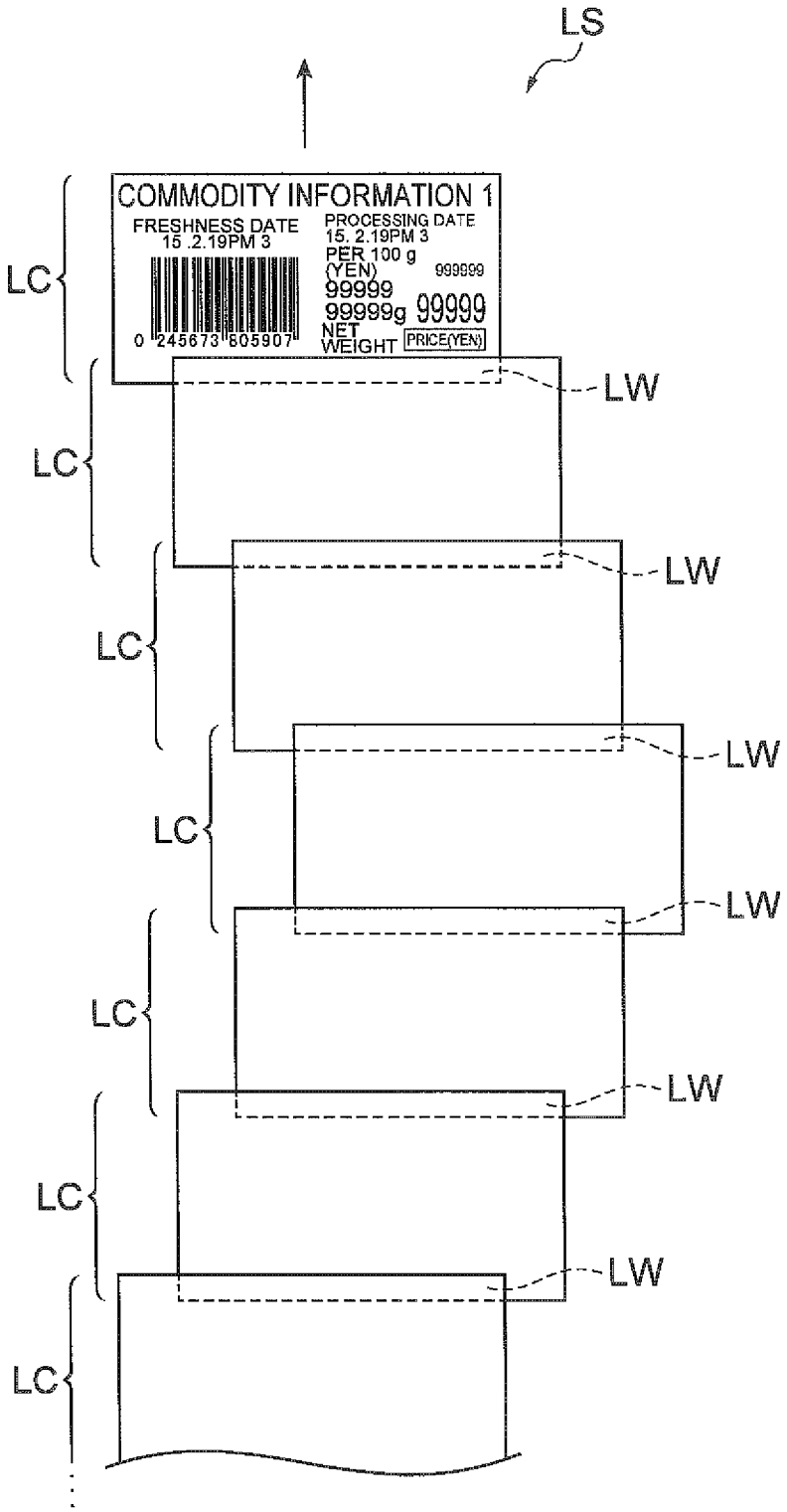
FIG. 11 is a plan view illustrating a label piece sheet issued by the printer unit according to a modification of the first embodiment.

According to the printer unit 30 that includes the moving mechanism 160 having such a configuration, a label piece sheet LS as illustrated in FIG. 11 can be issued. That is, every time a label piece LC is detached from the label L, a position switching unit 91 in a printer control unit 90 controls the moving mechanism 160, and moves the position of the holding roller 53 in multi stages, so that the label piece sheet LS as illustrated in FIG. 11 can be issued. With the label piece sheet LS, a user can easily recognize an end portion of the label piece LC, and thus can easily separate the label piece LC from the label piece sheet LS.

Second Modification

An information acquisition unit 93 may be included in a printer control unit 90, in addition to the configuration of the printer unit 30 according to the first modification, as illustrated in FIG. 5. The information acquisition unit 93 acquires commodity information printed on a label piece LC. To be specific, the information acquisition unit 93 acquires the commodity information printed on a label L, based on information to be printed on the label L, the information being transmitted from a main body control unit 70 to a print unit 33 via the printer control unit 90. A position switching unit 91 switches a position of a holding roller 53 in a right and left direction, based on a type of the commodity information acquired by the information acquisition unit 93.

In the printer unit 30 according to the second modification, every time a label L on which the commodity information is printed is detached by a cutter unit 40, as a label piece LCa (LCc), a position of a temporary adhesion unit 50 with respect to the print unit 33 is relatively moved in a first direction (the right and left direction illustrated in FIG. 1) perpendicular to a feeding direction of a label L and to a direction perpendicular to a printing surface of the label.

To be specific, the position switching unit 91 (see FIG. 5) in the printer control unit 90 controls the moving mechanism 160, and every time the label L is detected as the label piece LCa, the information acquisition unit 93 acquires the commodity information printed on the label piece LCa. Then, when the commodity information acquired by the information acquisition unit 93 is unchanged from the commodity information printed on the preceding label piece LCa, the position switching unit 91 switches the position of the holding roller 53 from a first position to a second position, or from the second position to the first position. Note that a moving amount of the holding roller 53 from the first position to the second position, or from the second position to the first position is a distance G1.

Figure 12:
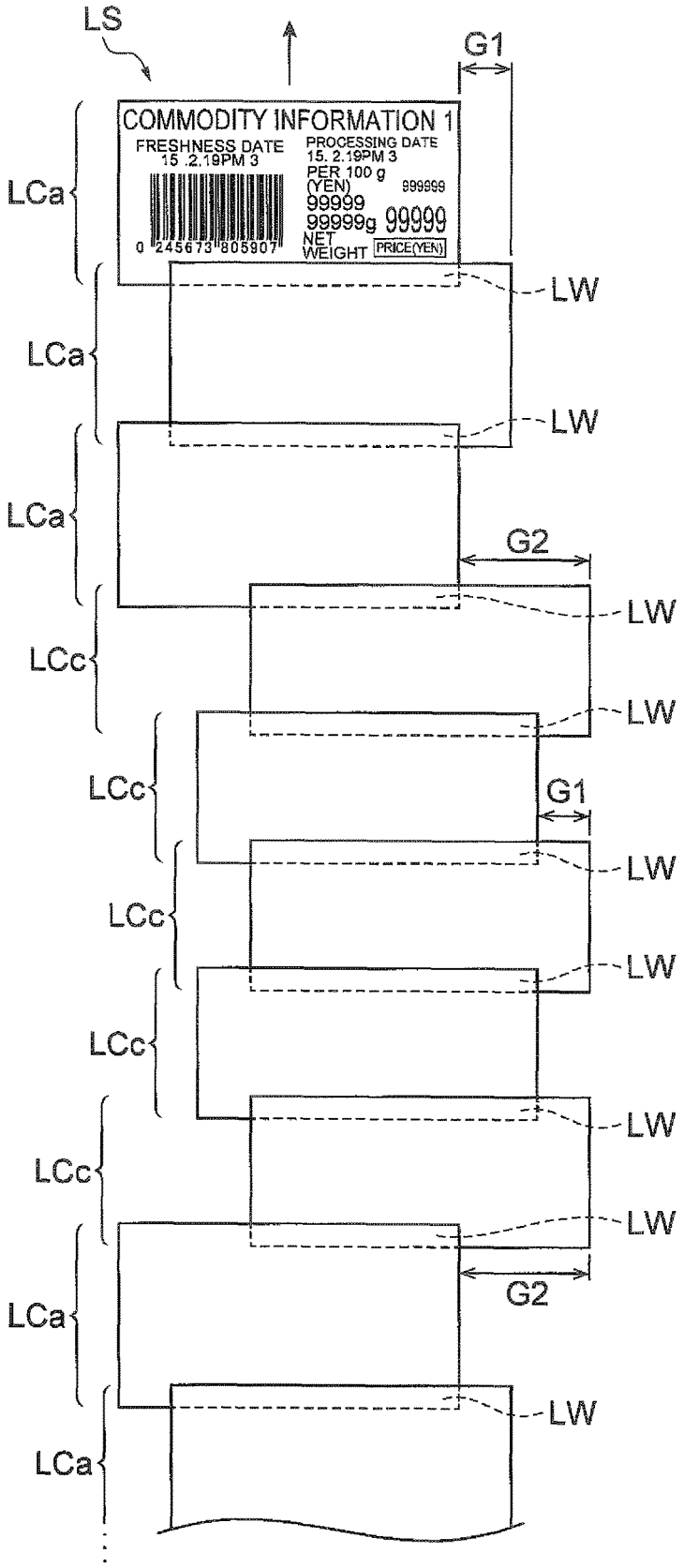
FIG. 12 is a plan view illustrating a label piece sheet issued by a printer unit according to a modification of the first embodiment.

As illustrated in FIG. 12, when the commodity information acquired by the information acquisition unit 93 is unchanged from the commodity information printed on the preceding label piece LCa, the label piece LC held by the temporary adhesion unit 50 is moved in the right and left direction by the distance G1. Therefore, a downstream-side end portion (tip end portion) of a subsequent label L is superimposed and affixed on an upstream-side end portion (rear end portion) of a preceding label piece LC in a state of being shifted in the right and left direction by the distance G1.

Meanwhile, when the commodity information acquired by the information acquisition unit 93 is changed from the commodity information printed on the preceding label piece LCa, the position switching unit 91 switches the position of the holding roller 53 from the first position to a third position, or from the second position to the third position. Note that the moving amount of the holding roller 53 from the first position to the third position, or from the second position to the third position is a distance G2 that is longer than the distance G1.

As described above, when the commodity information is unchanged from that on the preceding label piece LCa, the position of the holding roller 53 is moved by the distance G1, and when the commodity information is changed from that on the preceding label piece LCa (label piece LCc), the position of the holding roller 53 is moved by the distance G2 that is longer than the distance G1, whereby the label piece sheet LS as illustrated in FIG. 12 can be issued.

According to the printer unit 30 of the second modification, the position switching unit 91 switches the position of the holding roller 53 in the right and left direction at both of first timing when one label piece LC is detached, and second timing when change of the type of the commodity information printed on the label piece LC is acquired. Further, the distance G2 by which the holding roller 53 is moved at the second timing is larger than the distance G1 by which the holding roller 53 is moved at the first timing. Accordingly, each label piece LC can be shifted in the right and left direction. Therefore, the label piece sheet LS, as illustrated in FIG. 12, with which a user can easily recognize an end portion of each label piece LC, can be issued. Further, at timing when the commodity information is changed, the label piece LC is largely shifted in the right and left direction. Therefore, the label piece sheet LS, with which the user can easily recognize a group of the label pieces LC on which the same commodity information is printed, can be issued. With this label piece sheet LS, each label piece LC1, or each group of the label pieces LC with the same commodity information can be easily separated.

Second Embodiment

Next, an electronic balance 201 according to a second embodiment will be described. Note that differences of the electronic balance 201 according to the second embodiment from the electronic balance 1 according to the first embodiment in that various items in the electronic balance 201 can be input in a clerk-side operation unit 11 in an operation unit 10, a printer unit 30 does not include a moving mechanism 60, a printer control unit 290 including a print control unit 291 is included in place of a printer control unit 90 including a position switching unit 91, and a configuration of a label roll LR1 supported by a cassette unit 31 is different. Here, only different parts from the above-described first embodiment will be described. The same configuration (member) as that of the first embodiment is denoted with the same reference sign, and description is omitted.

In the operation unit 10, as described above, various items in the electronic balance 201 can be input in the clerk-side operation unit 11. For example, information such as lengths W1 and W2 of non-applied regions A1 in label rolls LR1 and LR2 (see FIGS. 14 and 16) described below can be input.

Further, the printer unit 30 is common to the first embodiment in that a cassette unit 31, a print unit 33, a cutter unit (cutting unit) 40, and a temporary adhesion unit 50 are included. However, as described above, the printer unit 30 is different from the first embodiment in that the moving mechanism 60 is not included, which relatively moves the position of the temporary adhesion unit 50 with respect to the print unit 33 in the first direction (the right and left direction illustrated in FIG. 1) perpendicular to the feeding direction of the label L and to the direction perpendicular to the printing surface of the label.

Figure 14:
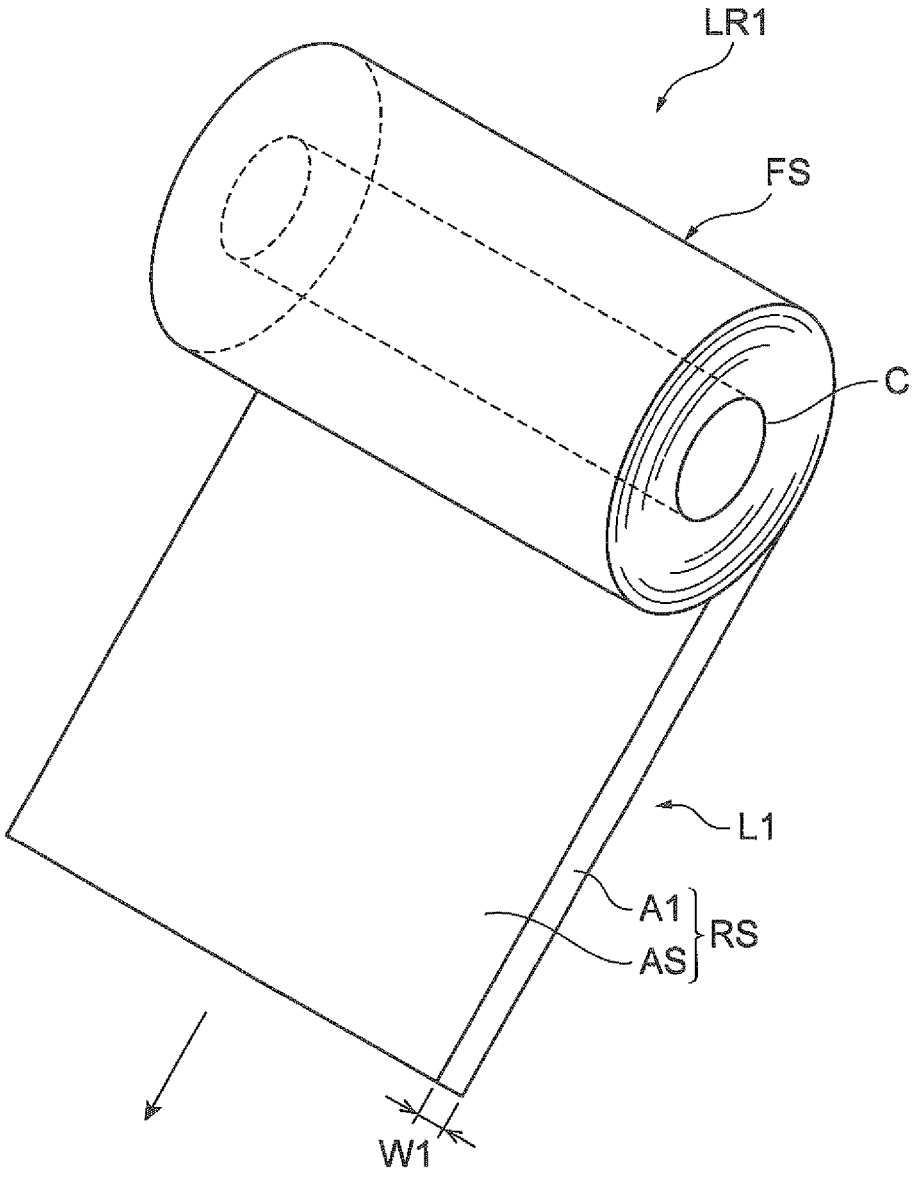
FIG. 14 is a perspective view of another example of a label roll used in a printer unit of the label issuing apparatus according to the second embodiment.

Further, a label roll LR1, which is different from the label roll LR used in the first embodiment, will be described. As illustrated in FIG. 14, the label roll LR1 is formed such that so-called a linerless label L is wound around a paper tube C and is formed into a roll shape. A linerless label L1 (hereinafter, simply referred to as "label L1") has different configurations on a front surface FS and a rear surface RS in a paper as a base material. The rear surface RS is a sticking surface on which an adhesive is applied. The front surface FS is a printing surface on which a heat sensitizer that develops a color by heat is applied, and a silicone resin as a release agent is further applied on the surface. Note that the label roll LR1 is wound around the paper tube C with the rear surface RS of the label L1 facing an inside.

On the sticking surface (rear surface RS), an applied region AS on which the adhesive is applied, and a non-applied region A1 on which no adhesive is applied are formed. The non-applied region A1 is formed in a longitudinal direction of the label L1, in other words, on one end portion in a width direction (second direction) perpendicular to a feeding direction (first direction) (the arrow direction illustrated in FIG. 14), and extends in the feeding direction, that is, in the longitudinal direction of the label L1. The length W1 of the non-applied region A1 in the width direction is 1 to 5 mm. The label roll LR1 is pulled out such that the rear surface (sticking surface) comes in contact with a platen roller (feeding unit) 37.

Figure 13:
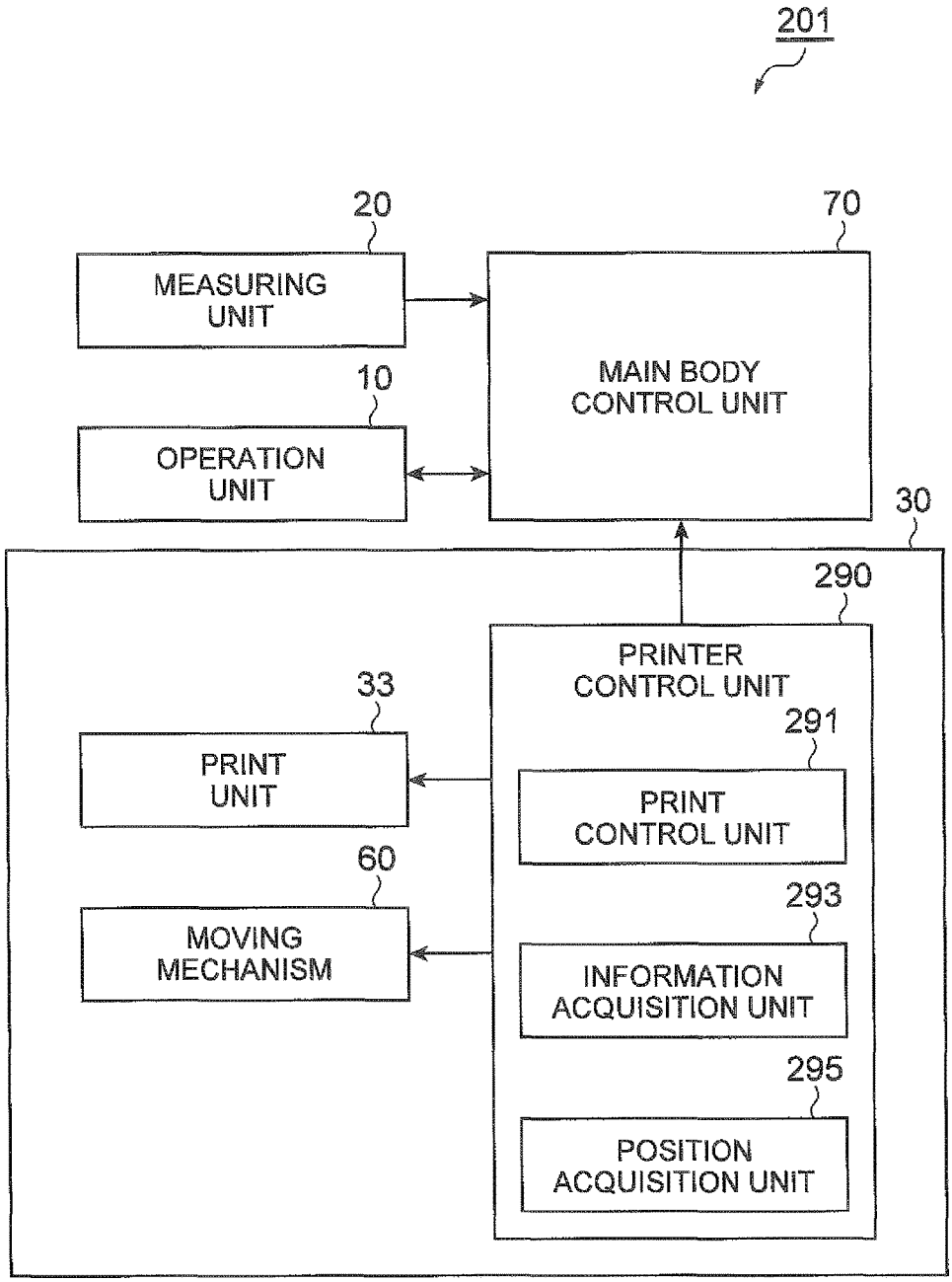
FIG. 13 is a functional block diagram illustrating functional configurations in an electronic balance including a label issuing apparatus according to a second embodiment.

Further, while the printer unit 30 is common to the first embodiment in that the cassette unit 31, the print unit 33, the cutter unit 40, and the temporary adhesion unit 50 are included, the printer unit 30 is different from the first embodiment in that the printer control unit 290 (see FIG. 13) including the print control unit 291 is included instead of the printer control unit 90 (see FIG. 5).

The print control unit 291 controls the print unit 33 (a print head 35 and the platen roller 37), based on the commodity information transmitted from the main body control unit 70, and prints the commodity information on the label L.

Next, an operation of the printer unit 30, which is one characteristic part of the second embodiment, is different from the first embodiment in that the label roll LR1 having the sticking surface on the rear surface RS is prepared, the sticking surface having the applied region AS on which the adhesive is applied, and the non-applied region A1 on which no adhesive is applied, as illustrated in FIG. 14, and the printer unit 30 uses such a label roll LR1. Note that, in FIGS. 6A to 6C, the upper side is the front surface FS that is the printing surface, and the lower side is the rear surface RS that is the sticking surface.

Further, the second embodiment is common to the first embodiment in that the label piece sheet LS obtained such that the printing surface of the subsequent label L is partially superimposed on the sticking surface of the preceding label piece LC1, as illustrated in FIGS. 6A to 6C, and the label piece sheet LS obtained such that the sticking surface of the subsequent label L is partially superimposed on the printing surface of the preceding label piece LC1, as illustrated in FIGS. 7A to 7C, may be issued.

Figure 15A:
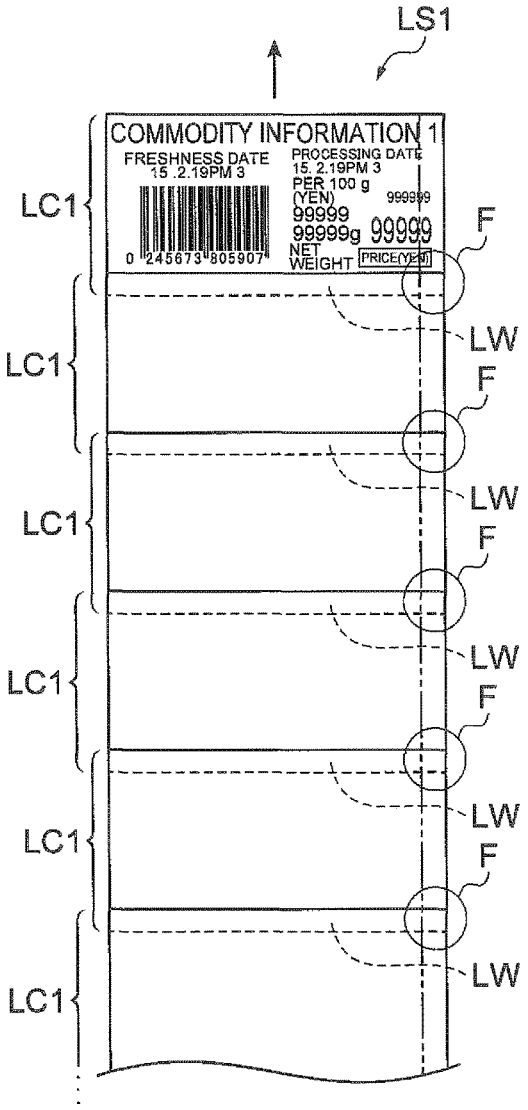
FIG. 15A is a plan view illustrating a label piece sheet issued by the label issuing apparatus according to the second embodiment.
Figure 15B:
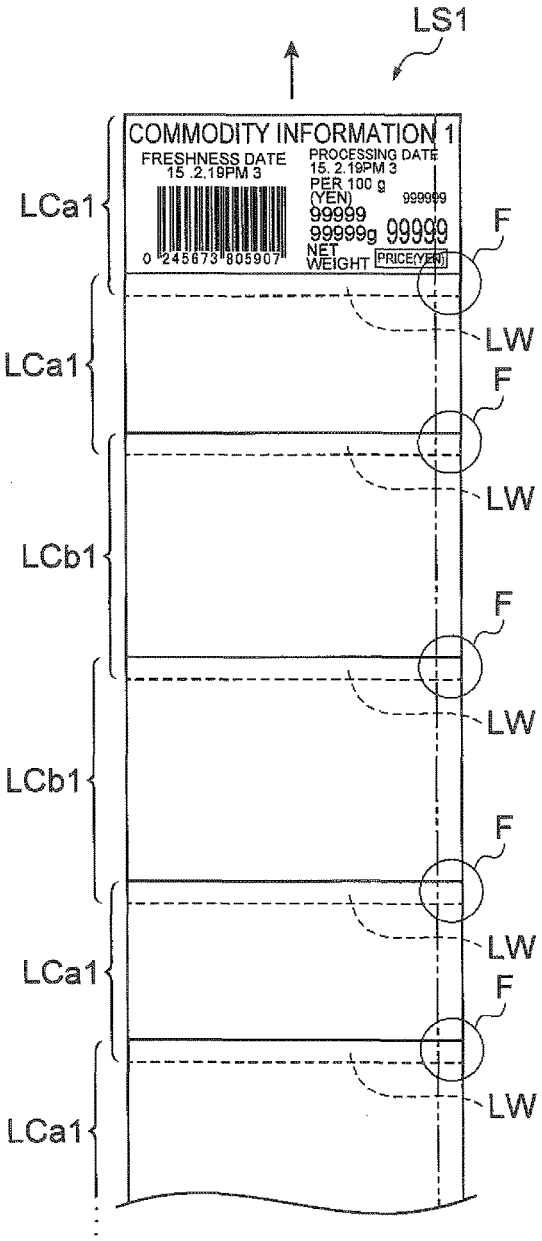
FIG. 15B is a plan view illustrating a label piece sheet issued by the label issuing apparatus according to the second embodiment.

FIGS. 15A and 15B illustrate a label piece sheet LS1 issued by partial superimposition of the sticking surface of the subsequent label L on the printing surface of the preceding label piece LC1. The directions of the arrows respectively illustrated in FIGS. 15A and 15B indicate a direction of being fed from the printer unit 30.

In the label piece sheet LS1, a downstream-side end portion (tip end portion) of a subsequently detached label piece LC1 is superimposed and affixed on an upstream-side end portion (rear end portion) of a precedingly detached label piece LC1. It is favorable to appropriately set the size of a superimposed and affixed region (superimposing margin) LW, based on the size of the label piece LC1. Such a superimposed and affixed state is sequentially repeated, so that the label piece sheet LS1 is linked in a sheet-like shape.

The label piece sheet LS1 of FIG. 15B is different from the label piece sheet LS1 of FIG. 15A in that a label piece LCa1 and a label piece LCb1 having mutually different lengths of the feeding direction are included. In the second embodiment, the label piece sheets LS1 as illustrated in FIGS. 15A and 15B can be issued. Further, the second embodiment is new in that the label piece sheet LS1 (see FIG. 15B) in which the plurality of label pieces LC1 (LCa1 and LCb1) is linked in a sheet-like shape can be issued while making use of the advantage of the linerless label L1 that the length of the label piece LC1 in the feeding direction can be freely changed according to the commodity information to be printed.

In the printer unit 30 of the second embodiment, every time the label piece LC1 is issued, the downstream-side end portion (tip end portion) of the subsequent label L is superimposed and affixed on the upstream-side end portion (rear end portion) of the preceding label piece LC. Then, such a superimposed and affixed state is sequentially repeated, so that a series of label pieces (label piece sheet LS1) linked in a sheet-like shape can be issued even though the label pieces LC1 are made of the linerless label L1. Further, on the rear surface RS (sticking surface) of the linerless label L1, the non-applied region A1 on which no adhesive is applied is formed on one of both end portions in the width direction (second direction), as illustrated in FIG. 14. Therefore, in the label piece sheets LS1 as illustrated in FIGS. 15A and 15B, a portion F where the label pieces are superimposed via the non-applied region A1 on which no adhesive is applied becomes in a rising state, compared with a portion where the label pieces are superimposed via the adhesive. Accordingly, the user can easily recognize an end portion of the label piece LC1, and thus can easily separate the label piece LC1 from the label piece sheet LS1. As a result, the label pieces LC1 generated from the label L1 can be caused to be in an easily separable state, and can be issued as a series of label pieces LC1 (label piece sheet LS1) linked in a sheet-like shape.

Since the linerless label L1 used in the printer unit 30 of the second embodiment is formed such that the length of the non-applied region A1 in the width direction becomes 1 to 5 mm, the label piece LC1 does not become an unnatural state when the label piece LC1 is affixed on a commodity (an article to be affixed), and the label piece LC1 can be easily separated from the label piece sheet LS1.

The second embodiment has been described. However, the present invention is not limited to the above embodiment, and various changes can be made without departing from the gist of the invention.

First Modification

Figure 16:
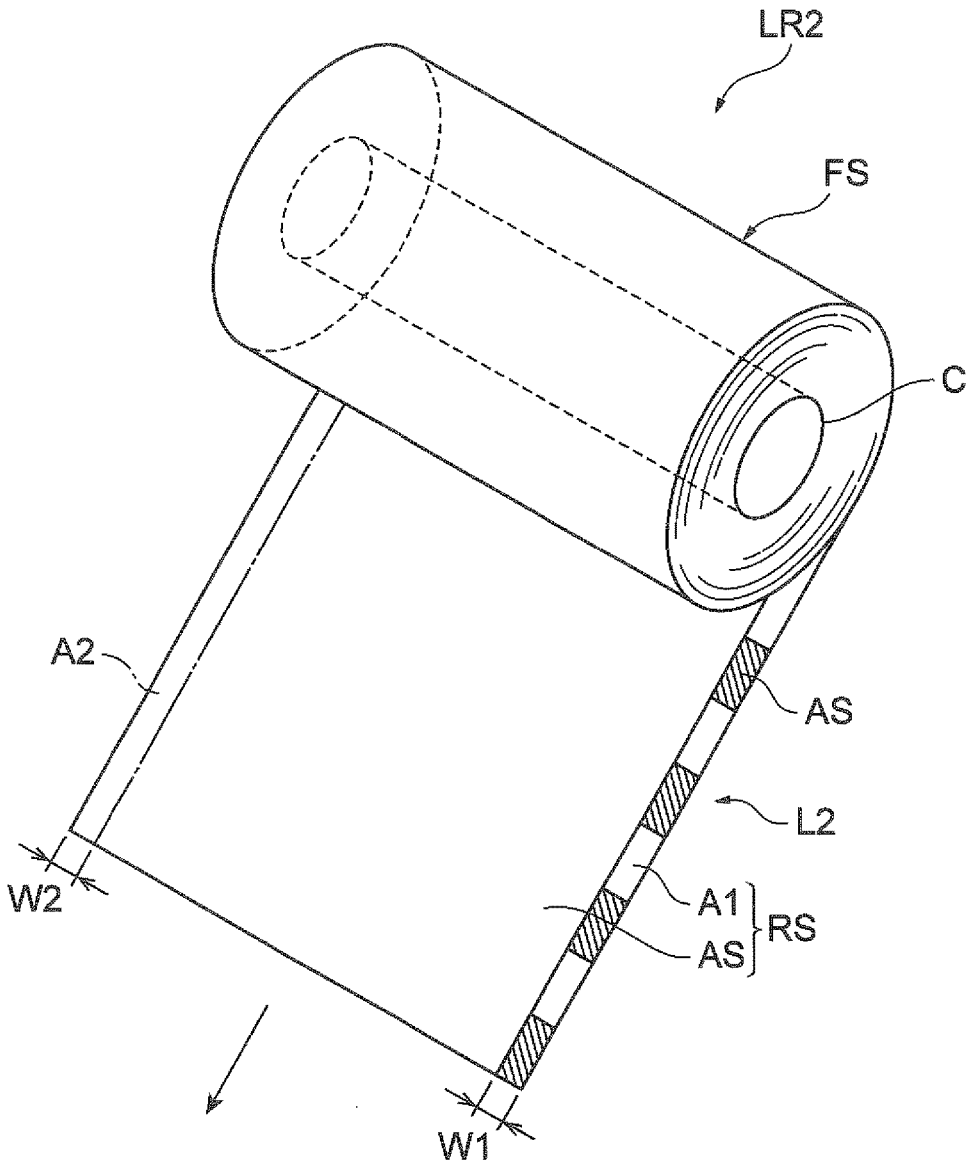
FIG. 16 is a perspective view illustrating another example of the label roll used in the label issuing apparatus according to the second embodiment.

A label roll LR2 as illustrated in FIG. 16 may be used in place of the label roll LR1 used in the second embodiment. A label L2 in the label roll LR2 has a different configuration of a rear surface RS from the label roll LR1. That is, the label L2 is different from the label rolls LR and LR1 in that an applied region AS on which an adhesive is intermittently applied in a longitudinal direction of the label L2 is formed on a non-applied region A1.

Even when the label roll LR2 is used in place of the label roll LR1 used in the second embodiment, portions F where label pieces LC1 are superimposed via a non-applied region A1 on which no adhesive is applied, in the label piece sheets LS1 as illustrated in FIGS. 15A and 15B, become in a rising state, compared with a portion where the label pieces LC1 are superimposed via the adhesive. Accordingly, a user can easily recognize an end portion of a label piece LC1, and thus can easily separate the label piece LC1 from a label piece sheet LS1. As a result, the label pieces LC1 generated from the label L2 can be caused to be in an easily separable state, and can be issued as a series of label pieces LC1 (label piece sheet LS1) linked in a sheet-like shape. Further, mutual separation of the label pieces LC1 becomes easy, while adhesion force between the label pieces LC1, and adhesion force to a commodity (article to be affixed) are maintained.

Further, a non-applied region A2 extending in the longitudinal direction of the label L2 may be formed in the other end portion different from the end portion where the non-applied region A1 is formed in a width direction (second direction), in addition to the non-applied region A1. Further, the non-applied region A2 may be formed in place of the non-applied region A1. Further, an applied region AS (not illustrated) on which the adhesive is intermittently applied in the longitudinal direction of the label L2 may be formed on the non-applied region A2.

Second Modification

An information acquisition unit 293 (see FIG. 13) may be included in a printer control unit 290, in addition to a configuration of a printer unit 30 according to the second embodiment. The information acquisition unit 293 acquires commodity information printed on a label piece LC. To be specific, the information acquisition unit 293 acquires the commodity information to be printed on a label L, based on information to be printed on the label L, the information being transmitted from a main body control unit 70 to a print unit 33 via the printer control unit 290.

Figure 17A:
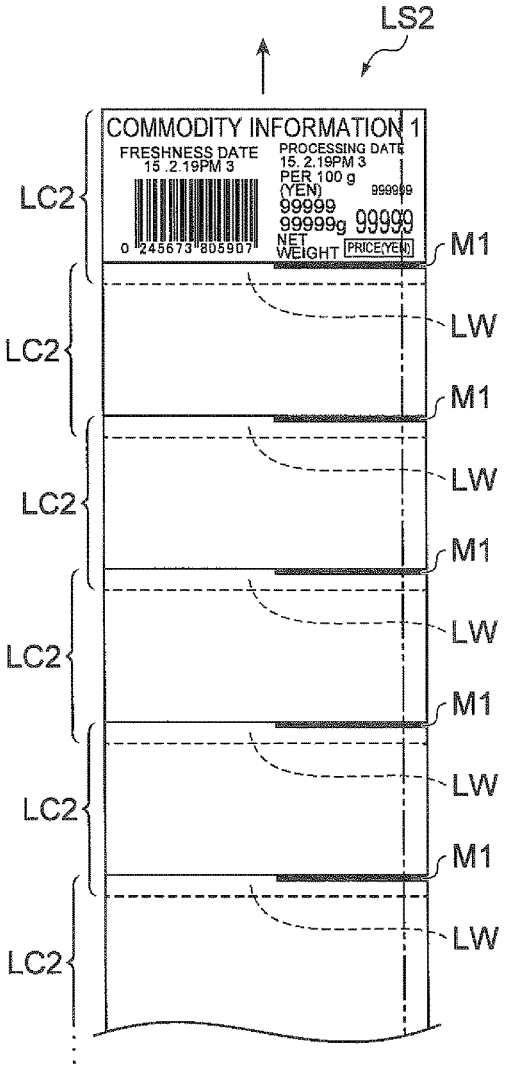
FIG. 17A is a plan view illustrating information printed on an end portion of a label piece in a feeding direction.
Figure 17B:
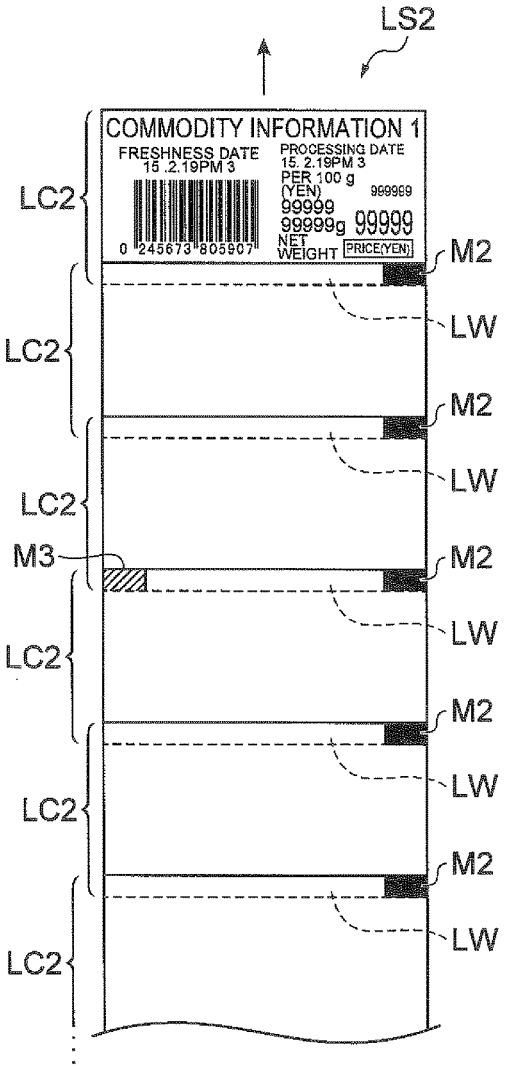
FIG. 17B is a plan view illustrating information printed on an end portion of a label piece in a feeding direction.

The print control unit 291 may control the print unit 33, and print end portion identification information M1 and M2, as illustrated in FIGS. 17A and 17B, with which an end portion of a label piece LC2 can be identified, on positions that become end portions in a feeding direction of the label pieces LC2 (the directions of the arrows illustrated in FIGS. 17A and 17B), in addition to the commodity information. The position of the end portion of the label piece LC2 in the label L2 can be identified based on a print amount to the label L2 corresponding to the commodity information acquired by the information acquisition unit 293, a length of the label piece determined from the print amount, or the like.

According to the label piece sheet LS2 issued by the printer unit 30 according to the second modification, the end portion identification information M1 and M2 such as a line (see FIG. 17A) or a figure (see FIG. 17B) is printed on the end portion in the feeding direction of the label piece LC2. Therefore, the user can more easily recognize the end portion of the label piece LC2 in the label piece sheet LS2.

Further, when the print control unit 291 detects that there is change of a type of the commodity information to be acquired by the information acquisition unit 293, that is, when printing to the label pieces LC2 for another type of commodity is performed after printing to the label pieces LC2 for the same commodity is continuously performed, the print control unit 291 may print change identification information M3, as illustrated in FIG. 17B, which indicates the commodity information has been changed, on the position of the end portion in the feeding direction of the label piece LC2. The change identification information M3 includes a line, a figure, a character, and the like. Further, the print control unit 291 may print the change identification information by changing the color of the end portion identification information M1 and M2, as illustrated in FIGS. 17A and 17B.

Further, similarly, when the print control unit 291 detects that there is change of a type of the commodity information to be acquired by the information acquisition unit 293, the print control unit 291 may change the position where the commodity information is printed. For example, the print control unit 291 may change the position where the commodity information is printed by putting the position where the commodity information is printed close to a center, a left side, a right side, an upper side, or a lower side of a position that becomes the label piece LC2.

According to the label piece sheet LS2 issued by the printer unit 30 according to the second modification, the user can easily recognize a place where a different type of label piece LC2 is started.

Third Modification

A position acquisition unit 295 (see FIG. 13) may be included in a printer control unit 290, in addition to a configuration of a printer unit 30 according to the second embodiment. The position acquisition unit 295 is a part that acquires a position of a non-applied region A1 (see FIGS. 14 and 16) on which no adhesive is applied in label rolls LR1 and LR2 (linerless labels L1 and L2). To be specific, for example, the position acquisition unit 295 acquires the position of the non-applied region A1, based on information input by a user through an operation unit 10 or the like.

A print control unit 291 controls a print unit 33, based on the position of the non-applied region A1 acquired by the position acquisition unit 295, so as to print commodity information, avoiding a printing surface (front surface FS) that is positioned back side of the non-applied region A1.

According to the printer unit 30 of the third modification, disorder of printing due to the commodity information being printed on a gap caused between the applied region AS and the non-applied region A1 (see FIGS. 14 and 16) in the labels L1 and L2 can be suppressed.

Other Modifications

In the printer unit 30 according to the first embodiment, and the first and second modifications of the first embodiment, an example of including the moving mechanism 60 that relatively moves the position of the temporary adhesion unit 50 with respect to the print unit 33 in the first direction (the right and left direction illustrated in FIG. 1) perpendicular to the feeding direction of the label L and to the direction perpendicular to the printing surface of the label has been described. However, the moving mechanism 60 may not be included. In the label issuing apparatus of this configuration, every time the label piece is detached from the label, the downstream-side end portion (tip end portion) of the subsequent label is superimposed and affixed on the upstream-side end portion (rear end portion) of the preceding label piece. Then, such a superimposed and affixed state is sequentially repeated, so that a series of label pieces linked in a sheet-like shape can be issued even though the label pieces are made of the linerless label.

In the printer unit 30 according to the first embodiment, and the first and second modifications of the first embodiment, an example of moving the holding roller 53 in the right and left direction every time one label piece LC is detached has been described. However, the holding roller 53 may be moved in the right and left direction every time a plurality of label pieces LC is detached.

In the printer unit 30 according to the first embodiment, and the first and second modification of the first embodiment (the second embodiment, and the first to third modifications of the second embodiment), an example of starting printing after retracting the label L (L1 or L2), from which the preceding label piece LC (LC1 or LC2) is detached, to the position of the print head 35 every time of printing has been described. However, an embodiment is not limited to the example. For example, first, the label L (L1 or L2) is retracted to the position of the print head 35. However, after that, the labels L are sequentially printed while being continuously fed, and when the rear end position that becomes the label piece LC (LC1 or LC2) arrives at the position of the cutter unit 40, the feeding of the label L may be stopped once and the label L may be cut.

The size of the superimposing margin LW of the preceding label piece LC and the subsequent label L is approximately determined according to the distance between the cutter unit 40 and the temporary adhesion unit 50. Therefore, it is favorable that the temporary adhesion unit 50 is configured to be movable in the feeding direction of the label L, and the superimposing margin can be adjusted according to a cut length of the label L (the length of the label piece LC).

The pressing member 51 may be configured to be movable along the surface of the holding roller 53. According to this configuration, the issued label piece LC can be freely switched to the front lowered posture or to the rear lowered posture. Further, the pressing member 51 may have a plate shape or a roller shape.

In the printer unit 30 according to the first embodiment, and the first and second modification of the first embodiment (the second embodiment, and the first to third modifications of the second embodiment), an example in which one of the cutter unit 40 is the fixed blade 41, and the other is the movable blade 43 has been described. However, both blades may be a movable blade.

An example in which the print head 35 is configured from a thermal-type print head has been described. However, an embodiment is not limited to the example, and various types such as an ink-ribbon type, and an ink-jet type print head can be employed.

In the printer unit 30 according to the first embodiment, and the first and second modification of the first embodiment (the second embodiment, and the first to third modifications of the second embodiment), an example of the print unit 33 having a configuration to print and feed the label L has been described. However, a print unit and a feeding unit may be separately configured.

In the electronic balance 1 (201) according to the first embodiment, and the first and second modification of the first embodiment (the second embodiment, and the first to third modifications of the second embodiment), an example in which the main body control unit 70 and the printer control unit 90 as control units are separately provided has been described. However, the main body control unit 70 and the printer control unit 90 may be integrally provided.

In the electronic balance 1 according to the first embodiment, and the first and second modifications of the first embodiment, an example of providing the solenoid 63 or the motor 167 as a drive unit of the moving mechanism 60 or 160 has been described. However, a motor that drives the platen roller 37 may be used. In this case, only at the time of back feed in printing, the moving mechanism 60 or 160 is driven, and the holding roller 53 may be moved.

The above-described various embodiments and modifications may be combined without departing from the gist of the present invention.

What is claimed is:

1. A label issuing apparatus comprising:

a print unit configured to print commodity information on a linerless label;

a feeding unit configured to feed the linerless label;

a cutting unit configured to detach the linerless label as a label piece; and a temporary adhesion unit configured to hold the label piece, and to adhere an upstream end portion in a feeding direction of the held label piece to a downstream end portion in a feeding direction of a subsequent label, the subsequent label being the linerless label next fed by the feeding unit, wherein the temporary adhesion unit is disposed further downstream in the feeding direction than the cutting unit, and includes a pressing member and a holding roller, the pressing member is configured to press the label piece against the holding roller such that the label piece is held from front and rear sides between the pressing member and the holding roller while the label piece is moving in the feeding direction, the holding roller is configured to move a downstream end portion in the feeding direction of the label piece to a position where the upstream end portion in the feeding direction of the label piece does not hinder progress of the downstream end portion in the feeding direction of the subsequent label, the pressing member is configured to press the label piece and the subsequent label directly against the holding roller while the label piece is moving in the feeding direction to thereby adhere the label piece to the subsequent label, and the pressing member and holding roller are configured to hold a series of label pieces in a state in which the label piece is adhered to the subsequent label.

2. The label issuing apparatus according to claim 1, wherein the temporary adhesion unit adheres a printing surface of the subsequent label to an adhesive surface of the label piece, or adheres an adhesive surface of the subsequent label to a printing surface of the label piece, by holding the label piece to be inclined in a direction intersecting with the feeding direction of the label.

3. The label issuing apparatus according to claim 1, wherein the print unit starts printing after the label piece has been detached and the linerless label has been retracted to a print position.

4. The label issuing apparatus according to claim 1, wherein a position of the temporary adhesion unit with respect to the feeding unit is switchably provided in a first direction approximately perpendicular to the feeding direction and to a direction perpendicular to a printing surface of the label piece.

5. The label issuing apparatus according to claim 4, further comprising:

a moving mechanism configured to relatively move the position of the temporary adhesion unit with respect to the feeding unit; and a control unit configured to control the moving mechanism to switch the position of the temporary adhesion unit.

6. The label issuing apparatus according to claim 5, wherein the control unit switches the position of the temporary adhesion unit every time the one label piece or a plurality of the label pieces is detached.

7. The label issuing apparatus according to claim 5, wherein the control unit alternately switches the position of the temporary adhesion unit to a first position and to a second position different from the first position every time the one label piece is detached.

8. The label issuing apparatus according to claim 5, further comprising:

an information acquisition unit configured to acquire the commodity information printed on the label piece, wherein the control unit switches the position of the temporary adhesion unit, based on a type of the commodity information acquired by the information acquisition unit.

9. The label issuing apparatus according to claim 5, wherein the control unit switches the position of the temporary adhesion unit at both of first timing when the one label piece is detached, and second timing when change of the type of the commodity information printed on the label piece is acquired, and a distance by which the temporary adhesion unit is moved at the second timing is made larger than a distance by which the temporary adhesion unit is moved at the first timing.

10. The label issuing apparatus according to claim 1, wherein the print unit prints the commodity information on the linerless label on which a region on which an adhesive is not applied, and extending in a first direction is formed on a sticking surface, and the feeding unit feeds the linerless label along the first direction; and the region is formed at least one of both end portions of the sticking surface in a second direction approximately perpendicular to the first direction.

11. The label issuing apparatus according to claim 10, wherein a length of the region in the second direction is 1 to 5 mm.

12. The label issuing apparatus according to claim 10, wherein the adhesive is intermittently applied on the region along the first direction.

13. The label issuing apparatus according to claim 10, wherein the print unit prints end portion identification information with which the end portion is identifiable on a position of an end portion in the feeding direction of the label piece.

14. The label issuing apparatus according to claim 10, further comprising:

an information acquisition unit configured to acquire the commodity information to be printed on the linerless label, wherein, when change of a type of the commodity information has been detected, based on the commodity information acquired by the information acquisition unit, the print unit prints change identification information that indicates that the commodity information has been changed, and/or changes a position where the commodity information is printed, on a position of an end portion in the feeding direction of the label piece.

15. The label issuing apparatus according to claim 10, further comprising:

a position acquisition unit configured to acquire a position of the region, wherein the print unit prints the commodity information, avoiding a back surface of the position acquired by the position acquisition unit.

16. The label issuing apparatus according to claim 1, wherein the feeding unit is configured to feed an upstream end portion of the subsequent label under the downstream end portion of the label piece, which is in a front lowered posture due to holding of the pressing member and the holding roller, and to adhere a printing surface of the subsequent label to a sticking surface of the label piece, or is configured to feed the subsequent label over the downstream end portion of the label piece, which is in a rear lowered posture due to holding of the pressing member and the holding roller, and to adhere a sticking surface of the subsequent label to a printing surface of the label piece.

17. The label issuing apparatus according to claim 1, wherein a contact position of the pressing member and the holding roller is disposed in front of or behind a rotation center of the holding roller along the direction in which the feeding unit feeds the linerless label.

18. The label issuing apparatus according to claim 1, wherein the holding roller is a driven roller, and the feeding unit is configured to feed the subsequent label so as to adhere and push the subsequent label onto the label piece held by the pressing member and the holding roller, and to feed the label piece from the temporary adhesion unit.

* * * * *